US005931458A

United States Patent [19]

Morimoto

[11] Patent Number: 5,931,458

[45] Date of Patent: Aug. 3, 1999

[54] PAPER-REVERSING APPARATUS FOR USE IN PROVIDING TWO-SIDED COPIES

[75] Inventor: Toshihide Morimoto, Gose, Japan

[73] Assignee: Sharp Kabushiki Kaisha, Osaka, Japan

[21] Appl. No.: 08/888,698

[22] Filed: Jul. 7, 1997

Related U.S. Application Data

[62] Division of application No. 08/628,188, Apr. 5, 1996, Pat. No. 5,690,325.

[30] Foreign Application Priority Data

Apr. 7, 1995 [JP] Japan ..... 7-82974

[51] Int. Cl.[6] ..... B65H 29/00

[52] U.S. Cl. ..... 271/186; 271/65; 271/902

[58] Field of Search ..... 271/65, 186, 273, 271/274, 302, 303, 902

[56] References Cited

U.S. PATENT DOCUMENTS

| | | | |
|---|---|---|---|
| 4,486,012 | 12/1984 | Bock et al. | 271/902 X |
| 4,699,367 | 10/1987 | Russel | 271/65 |
| 4,842,262 | 6/1989 | Carrish | 271/186 |
| 5,131,649 | 7/1992 | Martin et al. | 271/65 X |
| 5,210,616 | 5/1993 | Kawasaki et al. | 271/274 X |
| 5,215,298 | 6/1993 | Stemmle et al. | 271/186 X |
| 5,449,164 | 9/1995 | Quesnel et al. | 271/186 |

FOREIGN PATENT DOCUMENTS

| | | | |
|---|---|---|---|
| 57-072562 | 5/1982 | Japan . | |
| 57-072563 | 5/1982 | Japan . | |
| 113069 | 7/1983 | Japan | 271/65 |
| 236965 | 11/1985 | Japan | 271/65 |
| 4-352173 | 12/1992 | Japan . | |
| 286632 | 11/1993 | Japan | 271/186 |

*Primary Examiner*—Boris Milef

[57] ABSTRACT

A paper-reversing device includes: a driving roller that rotates in one direction; a plurality of driven rollers that are installed around the driving roller while being kept in contact with the driving roller, and that revolve around the driving roller while rotating on their respective axes following the rotation of the driving roller. There is a paper-sending roller that rotates without contacting the driving roller; a roller supporting plate for supporting the driving roller and the driven rollers; a paper-feeding guide section; a paper-reversing guide section; and a solenoid. Paper, which has been fed to the paper-feeding guide section, is sent to the paper-reversing guide section by being sandwiched between the driving roller and one of the driven rollers. Thereafter, the driven roller is separated from the driving roller and is pressed against the paper-sending roller by the revolution. As a result, the rear end of the paper is sandwiched between the paper-sending roller and the driven roller to be discharged. This paper-sending operation can be carried out simultaneously with the next round of paper-feeding operation of paper by the driving roller and another driven roller. Therefore, it becomes possible to provide a shorter paper interval with respect to the paper-sending operation of paper.

13 Claims, 40 Drawing Sheets

PAPER-REVERSING APPARATUS FOR USE IN PROVIDING TWO-SIDED COPIES

This application is a divisional of application Ser. No. 08/628,188, filed on Apr. 5, 1996, now U.S. Pat. No. 5,690,325 issued Apr. 7, 1995 the entire contents of which are hereby incorporated by reference.

FIELD OF THE INVENTION

The present invention relates to a paper-reversing device that is installed in, for example, a copying machine capable of providing double-sided copies.

BACKGROUND OF THE INVENTION

For example, a copying machine having a double-sided copying function is provided with a paper-reversing device for reversing paper in its leading and rear portions in the paper-transporting direction. As shown in FIG. 48, for example, a conventional paper-reversing device of this type is provided with a tilted tray 202 for switching back. A sheet of paper, which is to be reversed, is dropped from an entrance-side paper guide 201 onto the tray 202, and the sheet of paper on the tray 202 is pushed out by a paper-stopping member 203, sucked by a transport belt 204, and sent out with its leading and rear portions in a reversed state.

In the paper-reversing device of this type, the tray 202 tilts with its paper-sending side facing up; therefore, the oncoming paper is allowed to slide over the preceding paper located on the tray 202 and reach the paper-stopping member 203. This makes it possible to provide continuous paper-reversing operations.

The paper-transporting capability in a paper-reversing device, that is, the copying capability concerning how many copies can be made per one minute in a copying machine having the paper-reversing device, is determined by a paper-transporting speed and paper intervals (the distance between any two sheets of paper) during a paper-transporting process. Therefore, when it is impossible to increase the paper-transporting speed in order to improve the copying capability, it is necessary to narrow the paper intervals during the paper-transporting process.

However, in the above-mentioned paper-reversing device, no paper can be fed onto the tray 202 during the time when the paper, located at the lowest position on the tray 202, is sent by shifting the paper-stopping member 203 and rotating the transport belt 204. For this reason, it is difficult to shorten the paper intervals, and consequently difficult to obtain sufficient paper-transporting capability, that is, sufficient copying capability.

Moreover, in the above-mentioned paper-reversing device, when the size of paper is changed, it is necessary to adjust the positioning of the paper-stopping member 203 in response to the change. This requires a complicated mechanism, thereby resulting in a complicated construction. Furthermore, in the above-mentioned paper-reversing device, when paper is sent onto the tray 202, it is necessary to suck the paper onto the transport belt 204 by the use of air suction. For this reason, the transportation of paper cannot be started until the paper has been positively sucked onto the transport belt 204, and this also makes it impossible to shorten the paper intervals.

SUMMARY OF THE INVENTION

It is an objective of the present invention to provide a paper-reversing device that improves the paper-transporting capability by shortening paper intervals during paper transportation.

In order to achieve the above-mentioned objective, the first paper-reversing device of the present invention is characterized by having: a paper-feeding and sending roller means that has a plurality of rollers that rotate while being kept in contact with one another, and that is provided with first and second paper-feeding-side positions through which sheets of paper are fed between the rollers and first and second paper-sending-side positions through which sheets of paper are sent out from between the rollers; a paper-feeding guide section for guiding paper to the first paper-feeding-side position; a paper-reversing guide section having a curved section on its paper-feeding and sending end, that is, the end on the side of the paper-feeding and sending roller means, and a shift section that starts from a mid-point of the curved section and reaches the paper-feeding and sending end, the shift section being arranged so that it can move between (1) a paper-feeding position that is a position through which the paper, discharged from the first paper-sending-side position, is fed and (2) a paper-sending position that is a position through which the paper, discharged from the paper-feeding and sending end, is guided to the second paper-feeding-side position, and that corresponds to a position at which the curved section forms a straighter shape than that of the paper-feeding position; a paper-guide driving means for moving the shift section toward the paper-feeding position as well as toward the paper-sending position; and a paper-holding means for holding the paper that has been fed into the paper-reversing guide section.

With this arrangement, the sheet of paper, which has been fed into the paper-feeding guide section, is guided to the first paper-feeding-side position, and then sent by the rollers to the paper-reversing guide section which has its sift section located at the paper-feeding position. This sheet of paper stops when its rear end has passed through the rollers. At this time, the sheet of paper is held by the paper-holding means so as not to move.

In this state, when the paper-guide driving means moves the shift section of the paper-reversing guide section to the paper-sending position, the rear end of the sheet of paper shifts itself toward the second paper-feeding-side position along the driving roller of the paper-feeding and sending roller means due to its ability to make itself straighten. As a result, the rear end of the sheet of paper is pinched by the rollers, and the sheet of paper is sent from the paper-reversing guide section by the rollers. Here, if the shift section of the paper-reversing guide section is returned to the paper-feeding position with the rear end of the sheet of paper being pinched by the rollers, it is possible to get ready for the next paper feeding process.

Therefore, the paper-reversing device of the present invention makes it possible to feed a sheet of paper to the paper-reversing guide section by using the paper-feeding and sending roller means, while sending a sheet of paper from the paper-reversing guide section by using the paper-feeding and sending roller means. This enables a paper-sending operation with shorter paper intervals.

Further, in the second paper-reversing device of the present invention that has the same arrangement as the first paper-reversing device, the paper-reversing guide section is further provided with: a shiftable paper-feeding and sending end that is a portion of the paper-feeding and sending end and that is shiftable independently from the other portions of the paper-reversing guide section except for the above-mentioned portion; and driving means for the shiftable paper-feeding and sending end which shifts the shiftable paper-feeding and sending end so that the rear end of the sheet of paper, which has been fed from the first paper-sending-side position to the paper-feeding position, is shifted from the first paper-sending-side position to the second paper-feeding-side position by being pushed by the shiftable paper-feeding and sending end.

With this arrangement, when the rear end of the sheet of paper is shifted to the second paper-feeding-side position by moving the shift section of the paper-reversing guide section to the paper-feeding position, it is possible to forcefully shift the rear end of the sheet of paper to the second paper-feeding-side position by using the shiftable paper-feeding and sending end. This further ensures a positive paper-sending operation from the paper-reversing guide section.

Moreover, in the third paper-reversing device of the present invention which has the same arrangement as the first paper-reversing device, is characterized in that the paper-reversing guide section is further provided with a discharge guiding section that guides the sheet of paper, fed from the paper-feeding position, to a paper-guiding direction and that is installed on the side where the shift section is not installed, and that the paper-holding means shifts the sheet of paper forward and backward along the paper-guiding direction.

With this arrangement, when the rear end of a sheet of paper is shifted to the paper-feeding-side position that is located between the driving roller and the second driven roller of the paper-feeding and sending roller means by shifting the shift section of the paper-reversing guide section to the paper-sending position, the sheet of paper is temporarily sent further ahead of the paper-reversing guide section while the shift section of the paper-reversing guide section is being moved to the paper-sending position, and after the shift section has been moved to the paper-sending position, the sheet of paper is allowed to return to the original backward position. This arrangement ensures that the rear end of the paper is properly shifted to the paper-feeding-side position between the driving roller and the second driven roller, and consequently ensures a positive paper-sending operation from the paper-reversing guide section.

Furthermore, the fourth paper-reversing device of the present invention is characterized by having: a paper-feeding guide section for guiding a sheet of paper; a fed-paper transport means for transporting the sheet of paper that has been guided by the paper-feeding guide section; a paper-reversing guide section for allowing the rear end of the sheet of paper that has been transported by the paper-feeding transport means to drop down at a drop position; a paper-sending roller means having a lower paper-sending roller installed at the drop position and an upper paper-sending roller that is installed above the lower paper-sending roller and that is free to move to a paper-sending position at which it is in press-contact with the lower paper-sending roller and to a refuge position to which it retracts from the drop position after having been separated from the lower paper-sending roller, at least one of the lower and upper paper-sending rollers being a driving roller; and a roller-shifting means for shifting the upper paper-sending roller to the paper-sending position and to the refuge position.

In this arrangement, the sheet of paper, fed into the paper-feeding guide section, is sent to the paper-reversing guide section by the paper-sending transport means, and the rear end of the sheet of paper is guided by the paper-reversing guide section, and placed on the lower paper-sending roller of the paper-sending roller means. At this time, the upper paper-sending roller, which has been separated from the lower paper-sending roller, is located at the refuge position. In this state, when the upper paper-sending roller is shifted to the paper-sending position at which it is pressed against the lower paper-sending roller, the sheet of paper is sent from the paper-reversing guide section by the upper and lower paper-sending rollers of the paper-sending roller means.

As described above, in this paper-reversing device, the sheet of paper is placed on the lower paper-sending roller and sent from the paper-reversing guide section by the upper and lower paper-sending rollers by the separation of the upper paper-sending roller from the lower paper-sending roller and the press-contact of the upper paper-sending roller against the lower paper-sending rollers. This enables a paper-sending operation with shorter paper intervals.

Further, the fifth paper-reversing device of the present invention is characterized by having: a paper-feeding and sending roller means that is provided with a driving roller that rotates in one direction, a plurality of driven rollers that are installed around the driving roller while being kept in contact with the driving roller, and that rotates around the driving roller while revolving on its axis following the rotation of the driving roller, a paper-sending roller that rotates without contacting the driving roller, a roller supporting member that supports the axes of the driven rollers so as to allow them to rotate freely, and that provides a paper-feeding and sending state, wherein a predetermined driven roller is kept in contact with the paper-sending roller while the driven roller, located behind the predetermined driven roller, is kept in contact with the driving roller, by making the driven roller separate from the driving roller so as to make it in contact with the paper-sending roller at a predetermined time during the revolution; a paper-feeding guide section for guiding the sheet of paper between the driving roller and the driven roller that has been kept in contact with the driving roller during the paper-feeding and sending state; a paper-reversing guide section to which the sheet of paper that has passed between the driven roller and driving roller while being guided by the paper-feeding guide section is fed in the paper-feeding and sending state, and which is designed so that the rear end of the sheet of paper is allowed to move onto the paper-sending roller; and a paper-feeding and sending state setting means which sets the paper-feeding and sending roller means to the paper-feeding and sending state by blocking the rotation of the driven rollers, and releases the means from the state.

In this arrangement, when the paper-feeding and sending roller means is set to the paper-feeding and sending state, the sheet of paper that has been fed into the paper-feeding guide section is sent to the paper-reversing guide section by the driving roller and the driven roller contacting it, and when the rear end is separated from these rollers, the sheet of paper is stopped.

When the paper-feeding and sending roller means is released from the paper-feeding and sending state in this state, the driven roller, which has been in contact with the driving roller, rotates around the driving roller, and when it reaches a predetermined position around the driving roller, it is shifted and separated from the driving roller so that it is pressed onto the paper-sending roller. At this time, the rear end of the sheet of paper, which has been warped by being pushed by the driven roller that has been shifted and separated as described above, is pinched between the driven roller and the paper-sending roller. In this state, if the paper-feeding and sending roller means is again set to the paper-feeding and sending state, the sheet of paper, pinched between the driven roller and the paper-sending roller, is sent from the paper-reversing guide section by these rollers. At this time a paper-feeding operation can be carried out by the use of the driving roller and the driven roller that contacts the driving roller, which are located behind the driven roller contacting the paper-sending roller. Therefore, since the paper-sending operation from the paper-reversing guide section and the paper-feeding operation to the paper-reversing guide section can be carried out at the same time, it becomes possible to perform a paper-sending operation with shorter paper intervals.

For a fuller understanding of the nature and advantages of the invention, reference should be made to the ensuing detailed description taken in conjunction with the accompanying drawings.

DESCRIPTION OF THE EMBODIMENTS

[Embodiment 1]

Referring to FIGS. 1 through 6, the following description will discuss one embodiment of the present invention.

Figure 2:
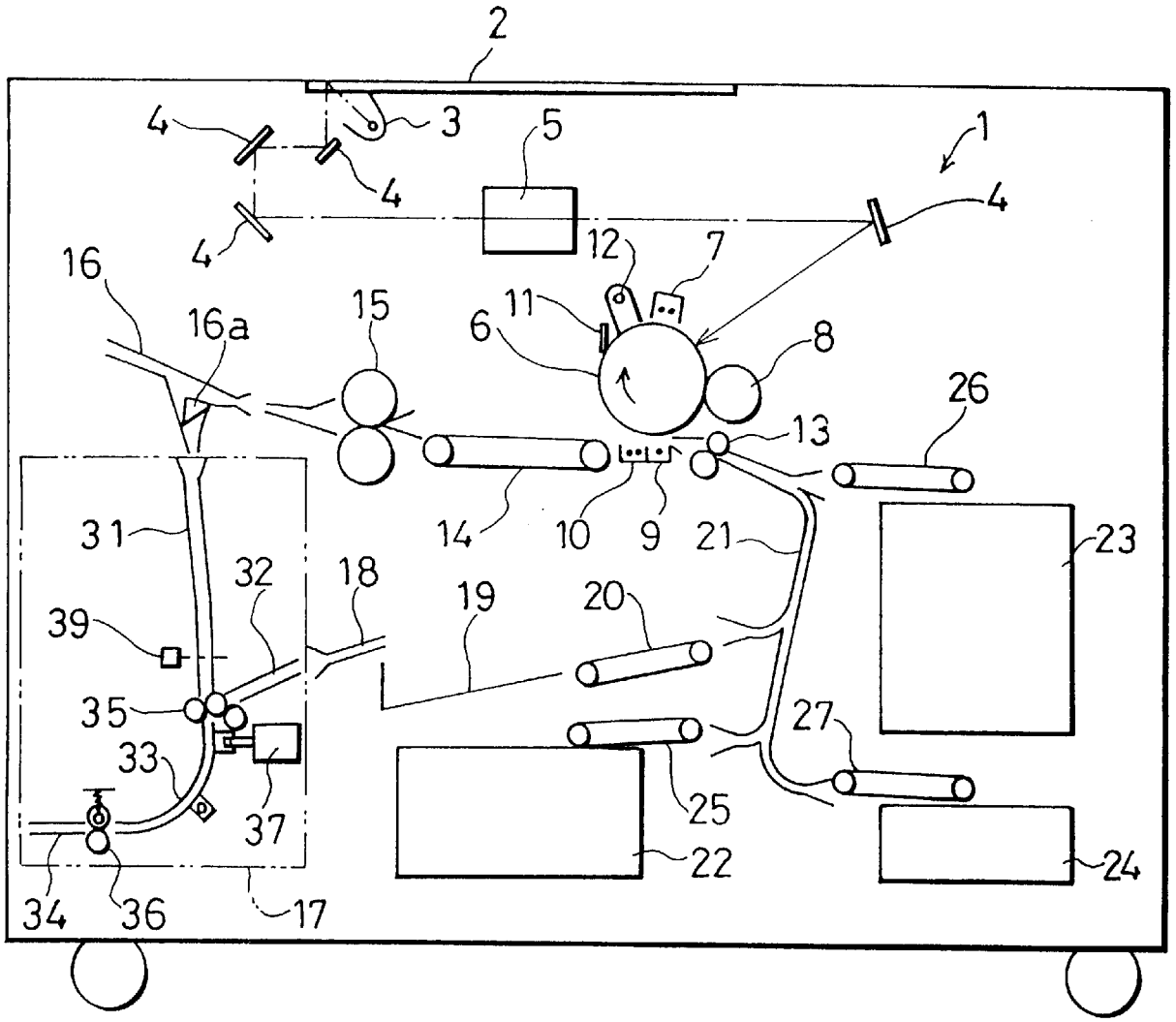
FIG. 2 is a schematic front view which shows an internal structure of a copying machine in which the paper-reversing device is installed.
Figure 3:
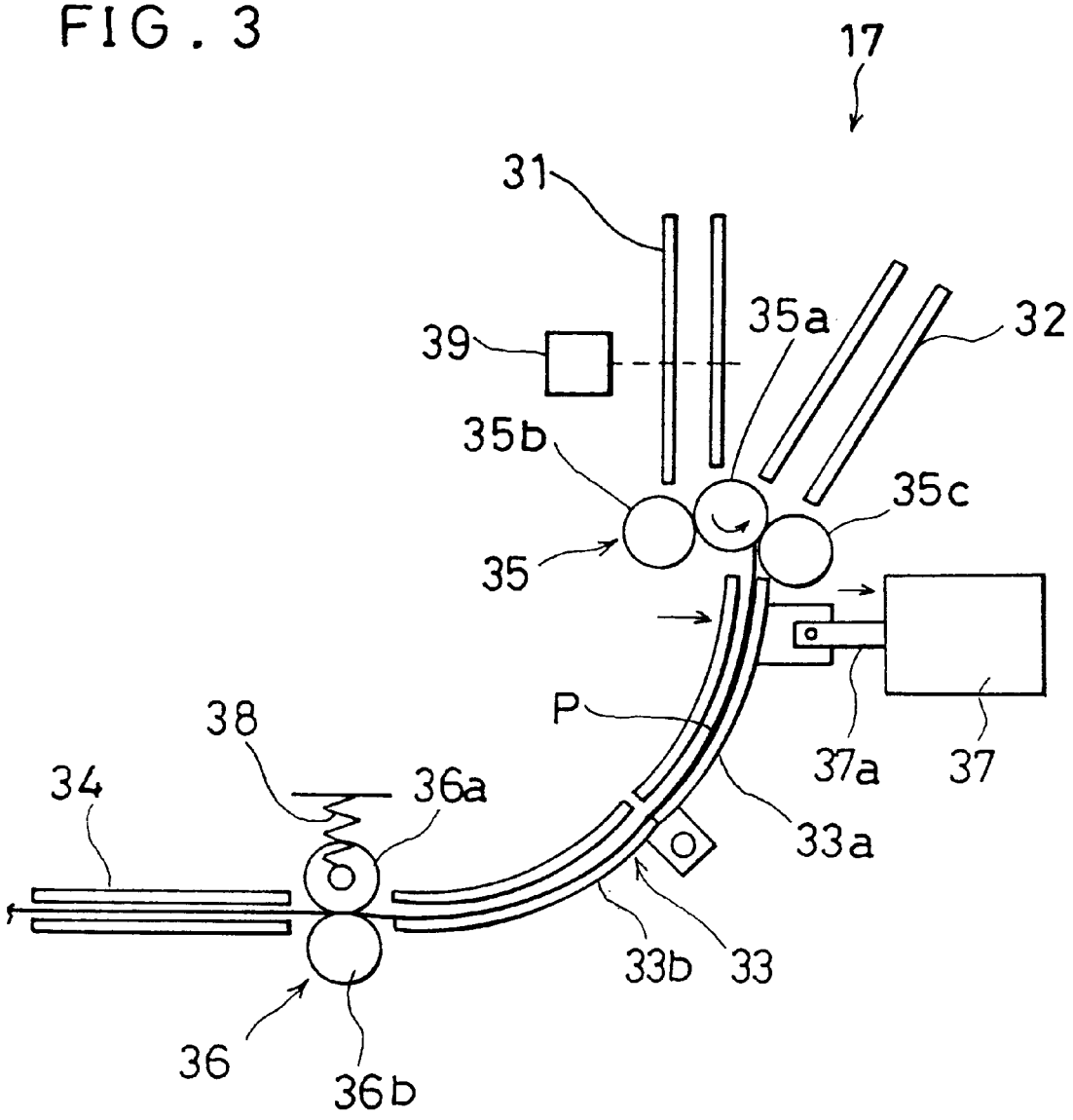
FIG. 3 is a schematic front view which shows a paper-sending operation of the paper-reversing device.

The description of the present embodiment will be made by reference to an example wherein a paper-reversing device is applied to a copying machine. As shown in FIG. 2, the copying machine has a document scanner 1 on its upper portion. The document scanner 1 scans an original that is placed on a document platen 2 by using light released from a light-source lamp 3, and directs its reflected light to the surface of a photoconductive drum 6 through a plurality of mirrors 4 and lens 5. A charger 7, a developing device 8, a transferring charger 9, separator charger 10, a cleaner 11 and a static eliminating lamp 12 are installed around the photoconductive drum 6. Further, a paper stop roller 13 is installed on the paper-feeding side of the photoconductive drum 6, and a conveyer belt 14, a fixing device 15 and a switching unit 16 are installed on the paper-sending side of the photoconductive drum 6.

The photoconductive drum 6, which has been charged by the charger 7 to have a predetermined electric potential, is exposed by reflected light from the original that has been directed by the document scanner 1. Thus, an electrostatic latent image is formed on the surface of the photoconductive drum 6, and the electrostatic latent image is developed by the developing device 8 to form a developer image. This developer image is transferred by the transferring charger 9 onto a sheet of paper that has been supplied through the paper stop roller 13. The sheet of paper is separated from the surface of the photoconductive roller 6 by the separator charger 10, and is sent by the conveyer belt 14 to the fixing device 15. In the fixing device 15, the developer image is fixed onto the sheet of paper through heating and pressing processes. The sheet of paper is discharged through the switching unit 16 onto a paper discharge tray, not shown, that is installed, for example, on an outer surface of the machine.

The switching unit 16 switches the transport direction of sheets of paper to a direction toward the paper-discharge tray and a direction toward a paper-reversing device 17 that is located below by the use of a gate 16*a*. The paper-reversing device 17 is used for reversing a sheet of paper in its leading and rear portions in the paper-transporting direction, for example, upon conducting a double-sided copying operation. In the paper-sending direction from the paper-reversing device 17, a paper guide 18, an intermediate tray 19 for temporarily holding the sheet of paper, a paper-feeding belt 20 for sending the sheet of paper from the intermediate tray 19, and a reversing transport path 21 for transporting the sheet of paper thus sent toward the paper stop roller 13. Moreover, the first through third paper trays 22 through 24 are connected to the reversing transport path 21 through paper-feeding belts 25 through 27. New sheets of paper are supplied by these first through third paper trays 22 through 24.

Figure 1:
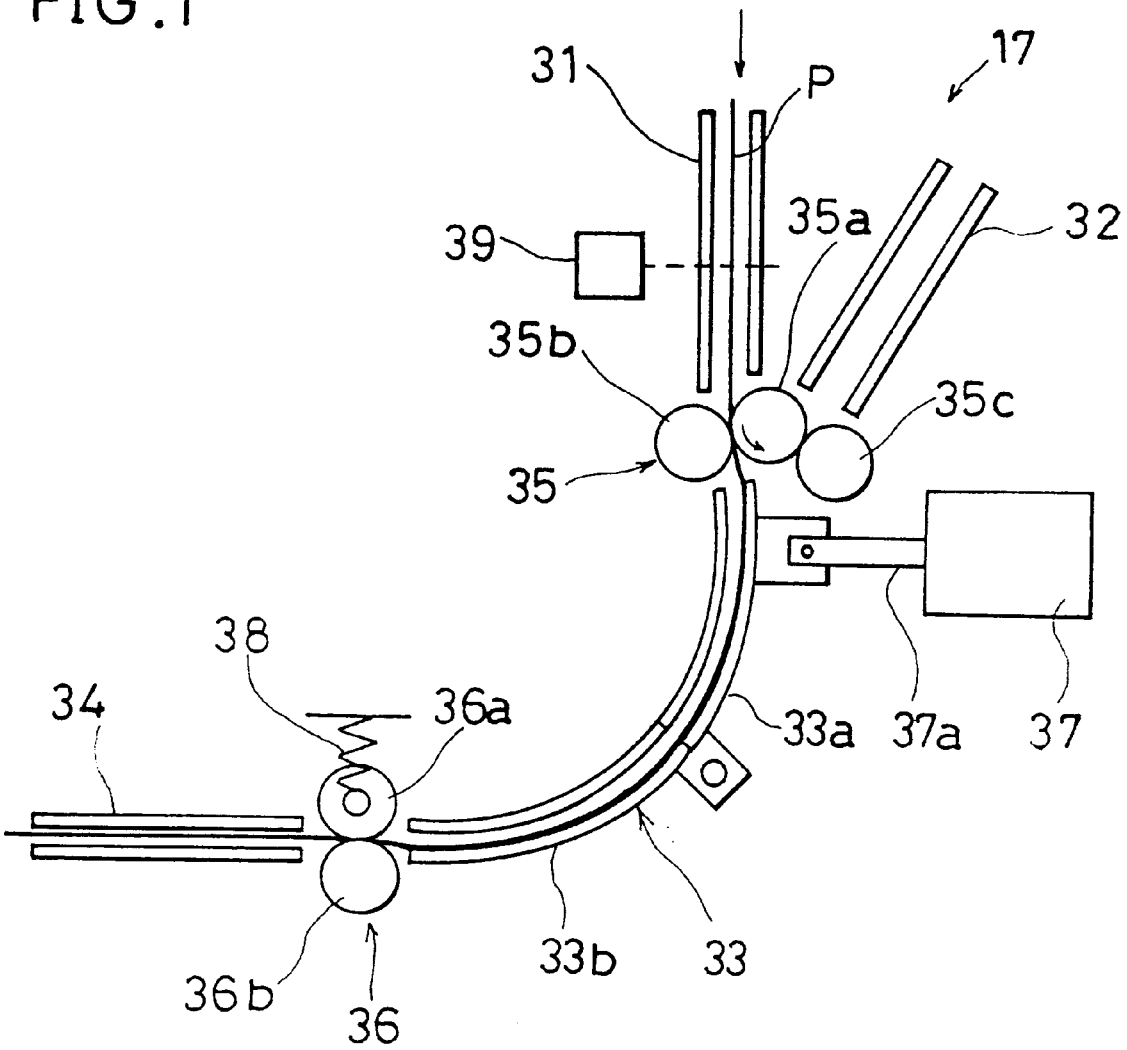
FIG. 1 is a schematic front view which shows a paper-reversing device of one embodiment of the present invention.

As illustrated in FIG. 1, the paper-reversing device 17 has a paper-feeding guide section 31, a paper-sending guide section 32, a paper-reversing guide section 33, and a terminal guide section 34 which are used for guiding sheets of paper. A triple-roller device 35, which functions as a paper-feeding and sending roller means, is installed between the paper-reversing guide section 33 and the paper-feeding guide section 31 as well as the paper-sending guide section 32. A paper-holding roller device 36, which functions as a paper-holding means, is installed between the paper-reversing guide section 33 and the terminal guide section 34.

The triple-roller device 35 has an arrangement wherein a paper-feeding driven roller 35*b*, which functions as the first driven roller, is installed on one side of a driving roller 35*a* that rotates in one direction, that is, in a direction of an arrow shown in FIG. 1 and a paper-sending driven roller 35*c*, which functions as the second driven roller, is installed on the other side thereof. These paper-feeding and paper-sending driven rollers 35*b* and 35*c* are kept in contact with the driving roller 35*a*, and allowed to rotate following the rotation of the driving roller 35*a*.

The paper-reversing guide section 33, which is formed into a curved shape, is divided into an upper guide section 33*a* functioning as the shift section and a lower guide section 33*b* functioning as a paper-discharge guide section, in the vicinity of its mid-point of the curved portion. The upper guide section 33*a* is free to pivot on its lower end toward a paper-feeding position, shown in FIG. 1, at which the upper end of the upper guide section 33*a* faces the proximity of a contact point between the paper-feeding driven roller 35*b* and the driving roller 35*a* as well as toward a paper-sending position, shown in FIG. 3, at which the upper end of the upper guide section 33*a* faces the proximity of a contact point between the paper-sending driven roller 35*c* and the driving roller 35*a*. In order to actuate this pivotal movement, the leading edge of a plunger 37*a* in a solenoid 37 (paper-guide driving means) is connected to the upper portion of the upper guide section 33*a*. The solenoid 37 allows the plunger 37*a* to retract to a state shown in FIG. 3 upon ON-operation, and also allows the plunger 37*a* to return to a state shown in FIG. 1 upon OFF-operation by the force of a spring, not shown.

The paper-holding roller device 36 has an upper roller 36*a* and a lower roller 36*b* that are paired driven rollers. The depressing force of the upper roller 36*a* is exerted onto the lower roller 36*b* by the dead weight of the upper roller 36*a*, and the upper roller 36*a* is supported by a spring 38 in a suspended state so as to reduce the depressing force. with this arrangement, the leading portion of the sheet of paper that has been pushed by the triple-roller device 35 and fed into the paper-reversing guide section 33 is allowed to pass between the upper roller 36*a* and the lower roller 36*b*.

Moreover, a paper sensor 39 is installed in the paper-feeding guide section 31 so as to detect the presence or absence of a sheet of paper that is passing through the paper-feeding guide section 31. This paper sensor 39 is connected to a control device 41 shown in FIG. 4. Further, the solenoid 37 and a roller driving device 40 that drives the driving roller 35*a* of the triple-roller device 35 are connected to the control device 41. The control device 41, which is provided with a microcomputer, controls the driving operation of the roller driving device 40, for example, based on the presence or absence of selection of the double-sided copying process, and also controls the driving operation of the solenoid 37 based on the detecting operation of the paper sensor 39. For example, it is possible to calculate the time at which the rear end of a sheet of paper passes through the triple-roller device 35, based on a constant paper-transporting speed and the detection of the rear end of the sheet of paper that is made by the paper sensor 39. Therefore, the control device 41 turns on the solenoid 37 a predetermined time after the paper sensor 39 has detected the rear end of a sheet of paper. For this purpose, the control device 41 has a timer inside thereof.

In the above-mentioned arrangement, if the double-sided copying process is selected in the copying machine, the sheet of paper, which has passed through the fixing device shown in FIG. 2 after having had a developer image transferred on its upper surface, is guided toward the paper-reversing device 17 by the switching unit 16.

As shown in FIG. 1, the sheet of paper (paper P) is guided by the paper-feeding guide section 31 of the paper-reversing device 17 to reach the triple-roller device 35, and sent to the paper-reversing guide section 33 by the driving roller 35*a* and the paper-feeding driven roller 35*b* of the triple-roller device 35. The leading portion of the paper P further passes between the upper roller 36*a* and the lower roller 36*b* of the paper-holding roller device 36 to reach the terminal guide section 34.

Figure 5:
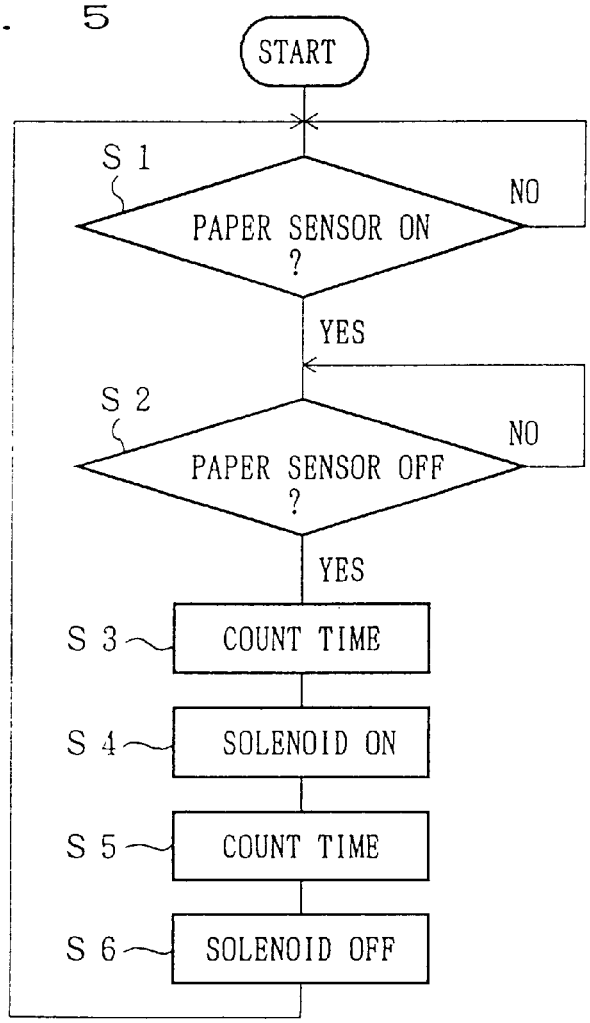
FIG. 5 is a flow chart showing an operation of the paper-reversing device.

As described above, the paper P enters the paper-feeding guide section 31, and when its leading portion has passed the paper sensor 39 of the paper-feeding guide section 31, the paper sensor 39 is turned on as shown in FIG. 5 (S1). Thereafter, when the rear end of the paper P has passed the paper sensor 39, the paper sensor 39 is turned off (S2). At this time, the control device 41 starts the timer to count a predetermined period of time, and, after completion of the time counting (S3), turns on the solenoid 37 (S4).

The above-mentioned time-counting operation of the timer is carried out so as to count the period of time from the passage of the rear end of the paper P at the paper sensor 39 to the passage thereof between the paper-feeding driven roller 35*b* and the driving roller 35*a* of the triple-roller device 35. Therefore, upon completion of the time-counting operation of the timer, the rear end of the paper P has passed between the paper-feeding driven roller 35*b* and the driving roller 35*a*, and the paper P is stopped because no transporting force is exerted by the triple-roller device 35. Here, at this time, the solenoid 37 is turned on, and the upper guide section 33*a* of the paper-reversing guide section 33, which has been located at the paper-feeding position, is pivoted to the paper-sending position.

In this case, the sheet of paper that is located at the paper-reversing guide section 33 always has the ability to return itself to a straight shape because of its elasticity. Therefore, when the upper guide section 33*a* of the paper-reversing guide section 33 is pivoted to the paper-feeding position, the rear end of the sheet of paper is shifted to a position between the driving roller 35*a* and paper-sending driven roller 35*c* along the driving roller 35*a* of the triple-roller device 35 since the sheet of paper is held by the paper-holding roller device 36 at its leading portion. Thus, the rear end of the paper P is sucked between the driving roller 35*a* and the paper-sending driven roller 35*c*, and the paper P is sent out through the paper-sending guide section 32 by the driving roller 35*a* and the paper-sending driven roller 35*c*.

Therefore, the control device 41, after turning on the solenoid 37 at S4, starts the timer to count a predetermined time, and after completion of the time-counting operation (S5), turns off the solenoid 37 (S6). When the solenoid 37 is turned off, the guide section 33*a* is returned to the paper-feeding position shown in FIG. 1, and gets ready for the next paper P.

Figure 6:
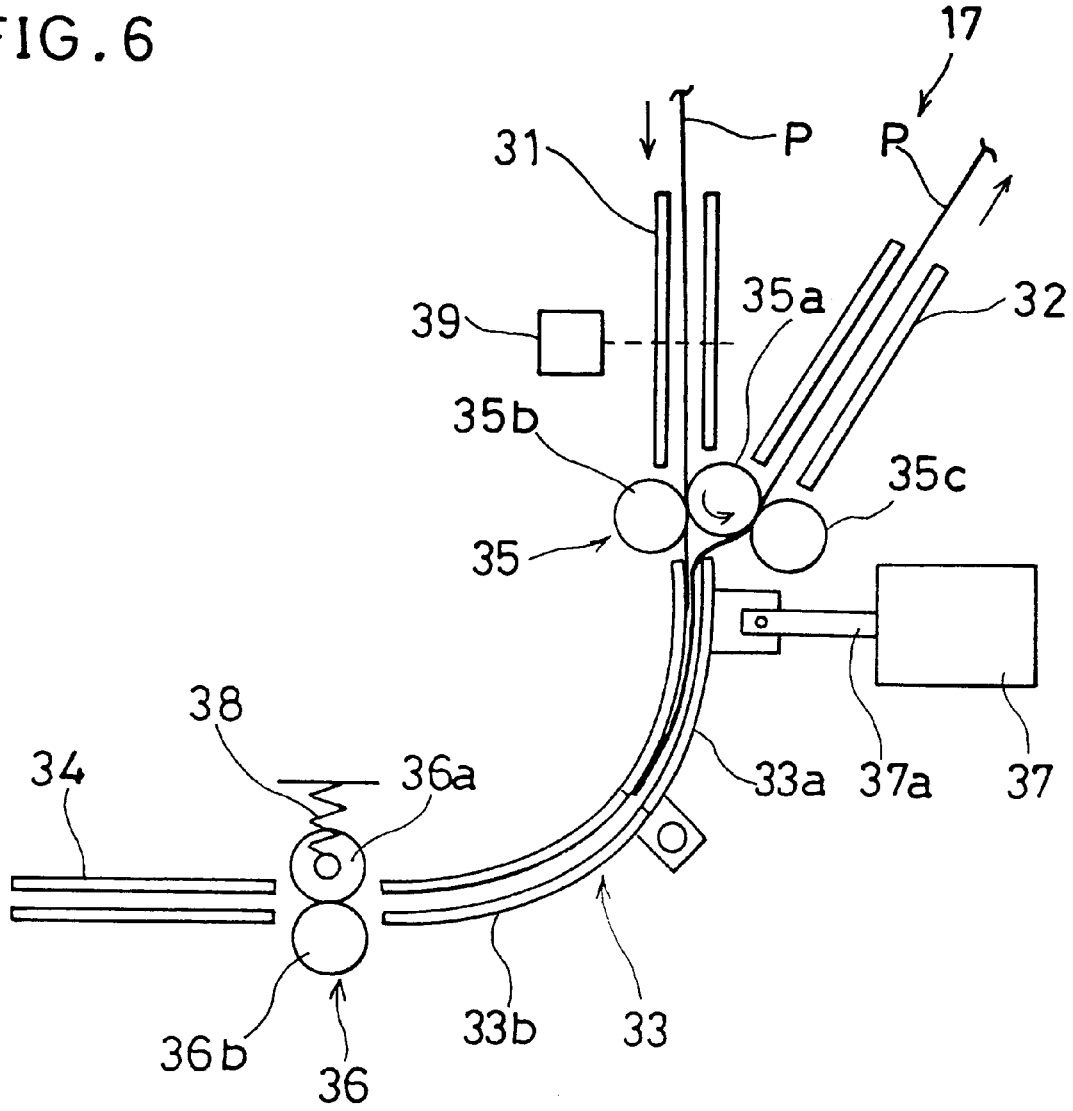
FIG. 6 is a schematic front view showing simultaneous paper-feeding and sending operations of the paper-reversing device.

The above-mentioned time-counting operation of the timer is carried out so as to count the period of time that is taken for the rear end of the paper P, that is, the leading portion in the present transportation, to be pinched between the paper-sending driven roller 35*c* and the driving roller 35*a* after the shift of the upper guide section 33*a* to the paper-sending position. Thus, when the upper guide section 33*a* is returned to the original paper-feeding position with the paper P being pinched between the paper-sending driven roller 35*c* and the driving roller 35*a*, it is possible to send the paper P and also to feed the next paper, as shown in FIG. 6.

The paper P, which has been sent out from the paper-reversing device 17, is placed onto the intermediate tray 19 in a reversed state in its leading and rear portions in the paper-transporting direction, as described earlier, and sent to the paper stop roller 13 after having been reversed in its upper and bottom surfaces by the reversing transport path 21. Thereafter, the bottom surface, that is, the present upper surface, is subjected to a copying operation, and the sheet of paper is discharged onto the paper discharge tray after having passed the switching unit 16.

[Embodiment 2]

Referring to FIGS. 7 through 11, the following description will discuss another embodiment of the present invention. Here, for convenience of explanation, those members that have the same functions and that are described in the aforementioned embodiment are indicated by the same reference numerals and the description thereof is omitted.

Figure 7:
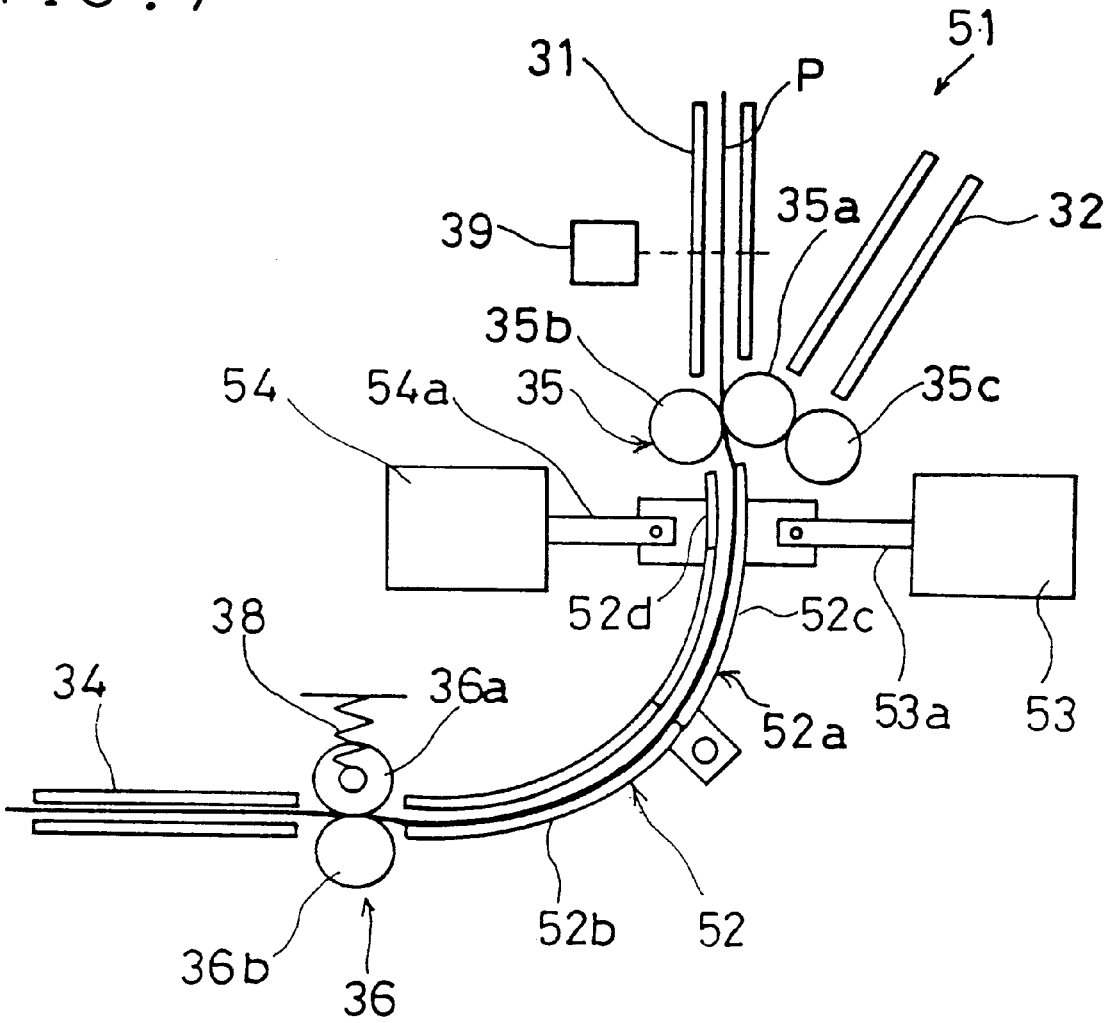
FIG. 7 is a schematic front view showing a paper-reversing device of another embodiment of the present invention.

As illustrated in FIG. 7, the paper-reversing device 51 of the present embodiment is provided with a paper-reversing guide section 52 in place of the paper-reversing guide section 33 shown in FIG. 1. The paper-reversing guide section 52 is divided into an upper guide section 52*a* functioning as the shift section and a lower guide section 52*b* in the vicinity of its mid-point, and the upper guide section 52*a* is further divided into an upper-guide main portion 52*c* and an upper-guide top side-wall 52*d* that functions as an shiftable paper-feeding and sending end. The upper-guide main portion 52*c* is free to pivot on its lower end toward the paper-feeding position of FIG. 7 as well as toward the paper-sending position of FIG. 8. In order to actuate this pivotal movement, the leading edge of a plunger 53*a* in a first solenoid 53 that functions as a paper-guide driving means is connected to the upper portion of the upper guide section 52*a*. The first solenoid 53 allows the plunger 53*a* to retract to a state shown in FIG. 8 upon ON-operation, and also allows the plunger 53*a* to return to a state shown in FIG. 7 upon OFF-operation by the force of a spring, not shown.

Moreover, the upper-guide top side-wall 52*d* is separated from the upper-guide main portion 52*c* so that it can carry out operations in a separate manner from the upper-guide main portion 52*c*. For this purpose, the upper-guide top side-wall 52*d* is installed in the top of the plunger 54*a* in the second solenoid 54 that functions as a shiftable paper-feeding and sending end driving means. The second solenoid 54 is installed on the side opposite to the first solenoid 53 with respect to the paper-reversing guide section 52 so that the shift direction of the plunger 54*a* is set in parallel with the shift direction of the plunger 53*a* of the first solenoid 53. The actions of the first and second solenoids 53 and 54 are controlled by a control device 55 shown in FIG. 10.

The paper-reversing device 51 having the above-mentioned arrangement is applied to a copying machine in the same manner as the paper-reversing device 17 shown in FIG. 2.

Figure 11:
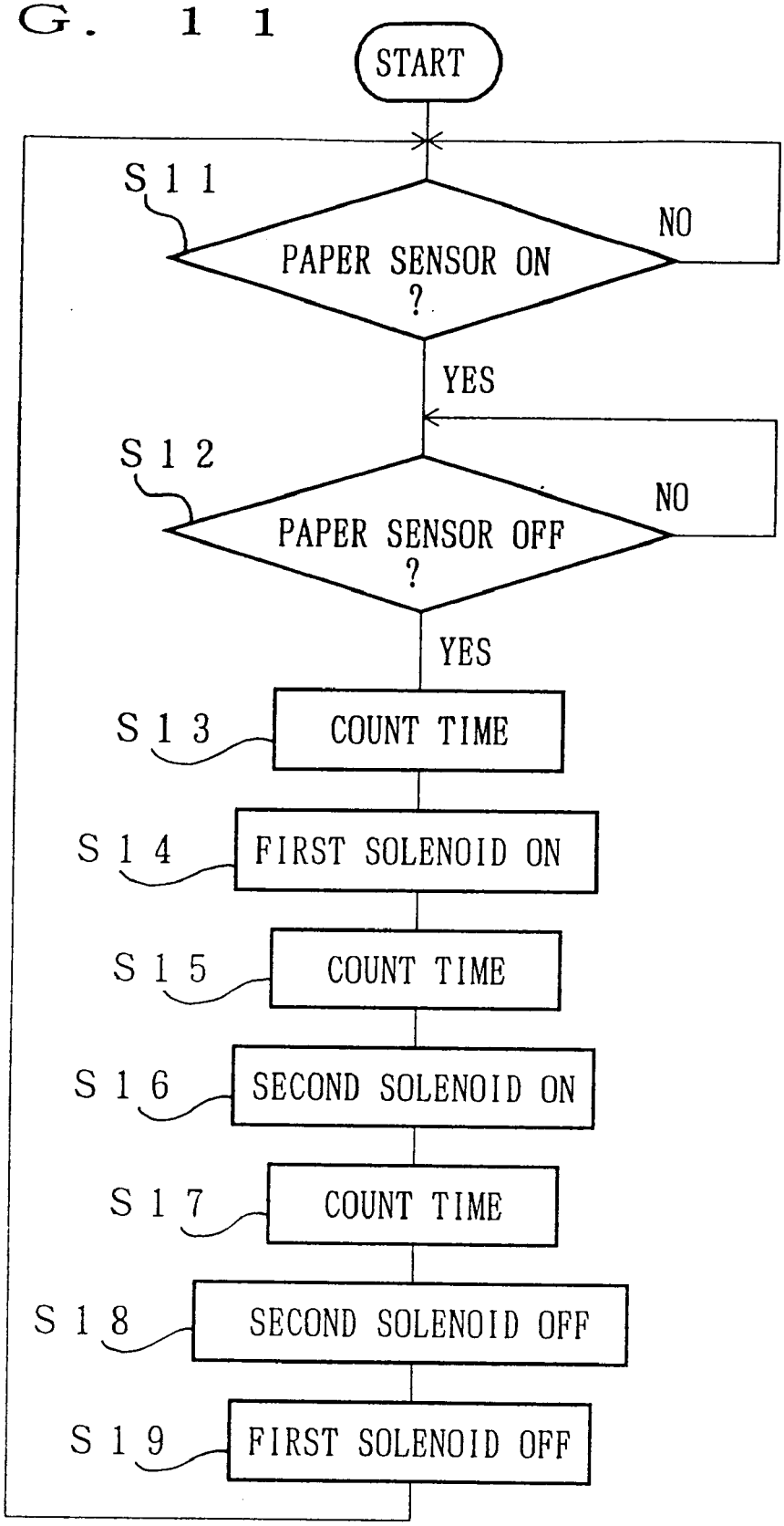
FIG. 11 is a flow chart showing the operation of the paper-reversing device of FIG. 7.

As shown in FIG. 7, in the present paper-reversing device 51 having the above-mentioned arrangement, in a state wherein the upper guide section 52*a* of the paper-reversing guide section 52 is placed at the paper-feeding position, when the paper P is passing through the paper sensor 39, the paper sensor 39 is turned on (S11), and then turned off (S12) in response to this movement, as shown in FIG. 11.

Figure 8:
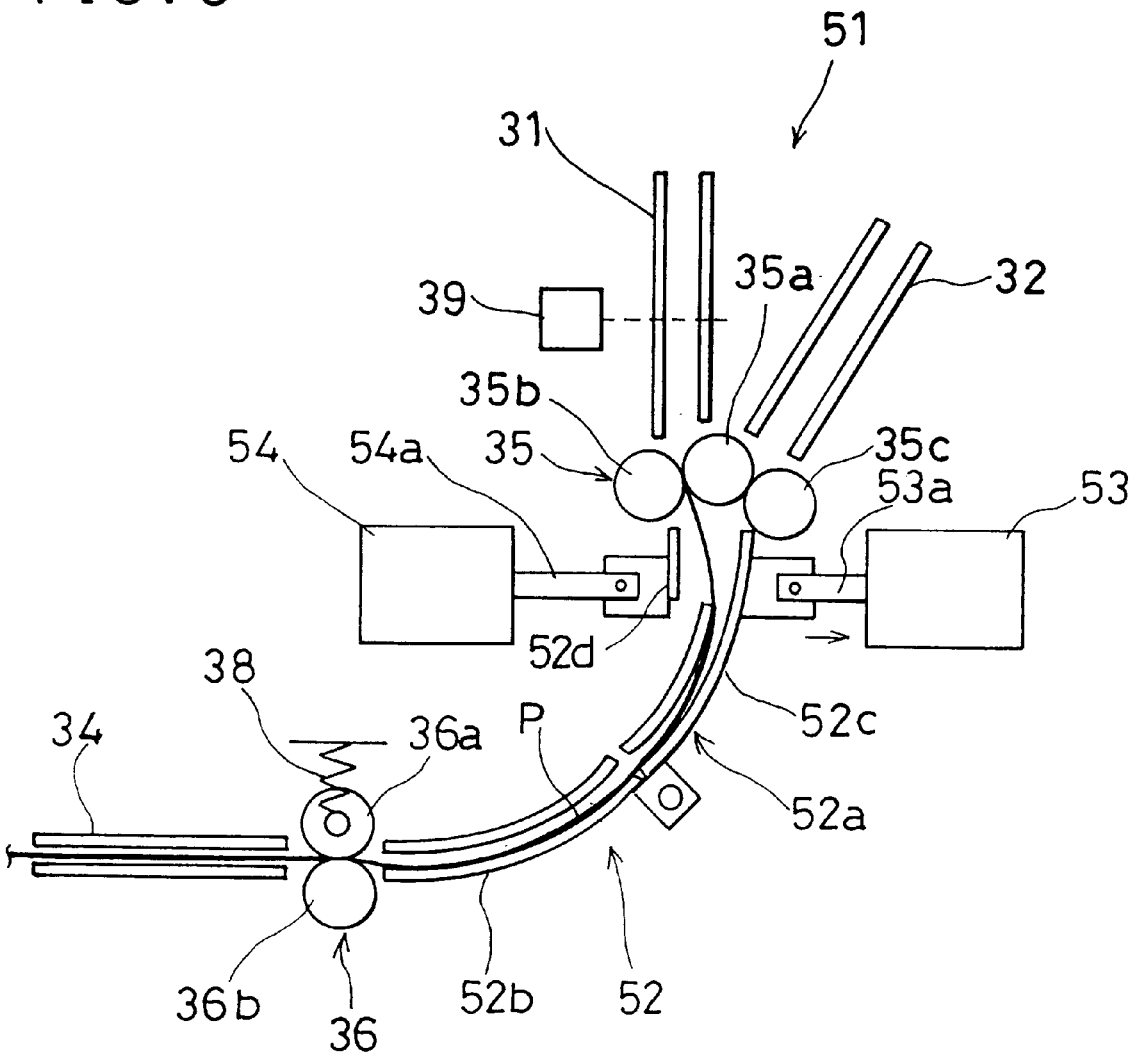
FIG. 8 is a schematic front view showing a transitional operation to a paper-sending operation of the paper-reversing device of FIG. 7.

Then, after completion of a predetermined time-counting operation made by the timer (S13), that is, after the rear end of paper P has passed between the paper-feeding driven roller 35*b* and the driving roller 35*a*, the control device 55 turns on the first solenoid (S14). Thus, as shown in FIG. 8, only the upper-guide main portion 52*c* of the upper guide section 52*a* of the paper-reversing guide section 52 is shifted to the paper-sending position.

Figure 9:
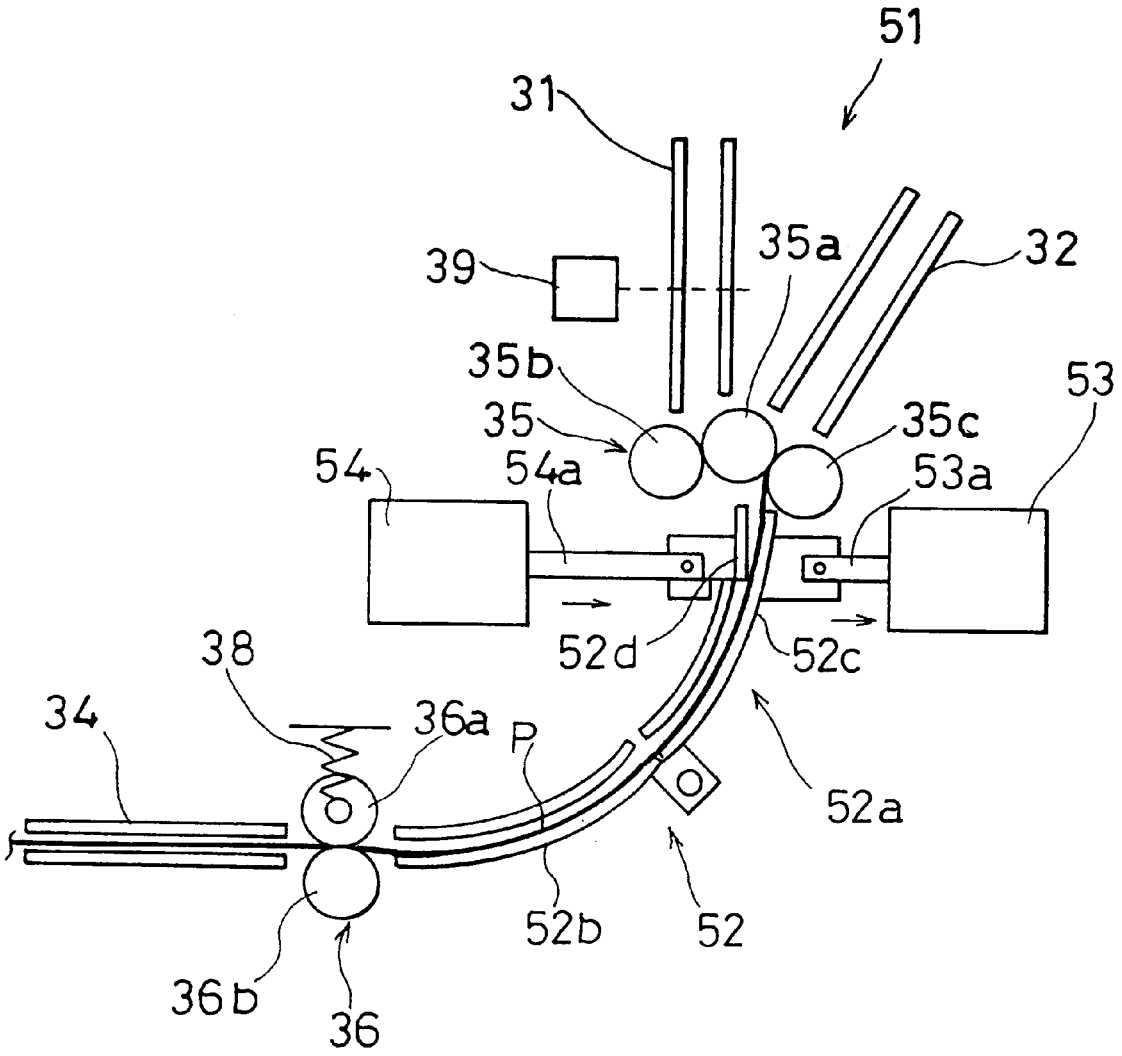
FIG. 9 is a schematic front view showing a paper-sending operation of the paper-reversing device of FIG. 7.
Figure 10:
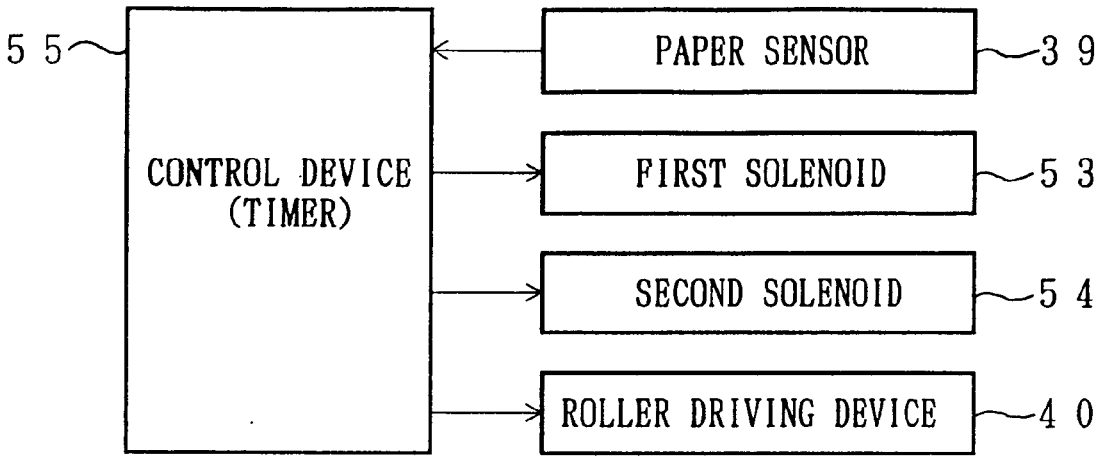
FIG. 10 is a block diagram showing a structure of a control system of the paper-reversing device of FIG. 7.

Next, after completion of a predetermined time-counting operation made by the timer (S15), that is, after the upper-guide main portion 52*c* has completed the shift that was actuated by the turning-on of the first solenoid 53, the control device 55 turns on the second solenoid 54 (S16). Consequently, as shown in FIG. 9, the upper-guide top side-wall 52*d* of the upper guide section 52*a* of the paper-reversing guide section 52 is shifted to the paper-sending position so that the rear end of the paper P is pushed by the upper-guide top side-wall 52*d*, and allowed to move to a position between the driving roller 35*a* and the paper-sending driven roller 35*c* along the surface of the driving roller 35*a*. Thereafter, the paper P, the rear end of which is sucked between the driving roller 35*a* and the paper-sending driven roller 35*c* by its ability to straighten itself, is sent out through the paper-sending guide section 32 by the driving roller 35*a* and the paper-sending driven roller 35*c*.

Therefore, upon completion of a predetermined time-counting operation made by the timer after the turning-on of the second solenoid 54 at S16 (S17), that is, after the end of the paper P has been pinched between the paper-sending driven roller 35*c* and the driving roller 35*a*, the control device 55 turns off the second solenoid 54 and the first solenoid 53 in this order (S18 and S19). When the first and second solenoids 53 and 54 are turned off, they are returned to the original state shown in FIG. 7 by a spring force, not shown. Consequently, the upper-guide main portion 52*c* and upper-guide top side-wall 52*d* are returned to the paper-feeding position shown in FIG. 7, thereby getting ready for the next paper. In this state, in the same manner as the paper-reversing device 17 shown in FIG. 6, it is possible to send out the paper P, and also to feed the next paper.

In the present paper-reversing device 51, when the paper P is sent out, after the upper-guide main portion 52*c* has been shifted from the paper-feeding position to the paper-sending position, the rear end of the paper P is forcefully shifted from the nip between the paper-feeding driven roller 35*b* and the driving roller 35*a* to the nip between the paper-sending driven roller 35*c* and the driving roller 35*a*. This arrangement further ensures a positive paper-sending operation of the paper P.

[Embodiment 3]

Referring to FIGS. 12 through 15, the following description will discuss another embodiment of the present invention. Here, for convenience of explanation, those members that have the same functions and that are described in the aforementioned embodiment are indicated by the same reference numerals and the description thereof is omitted.

Figure 12:
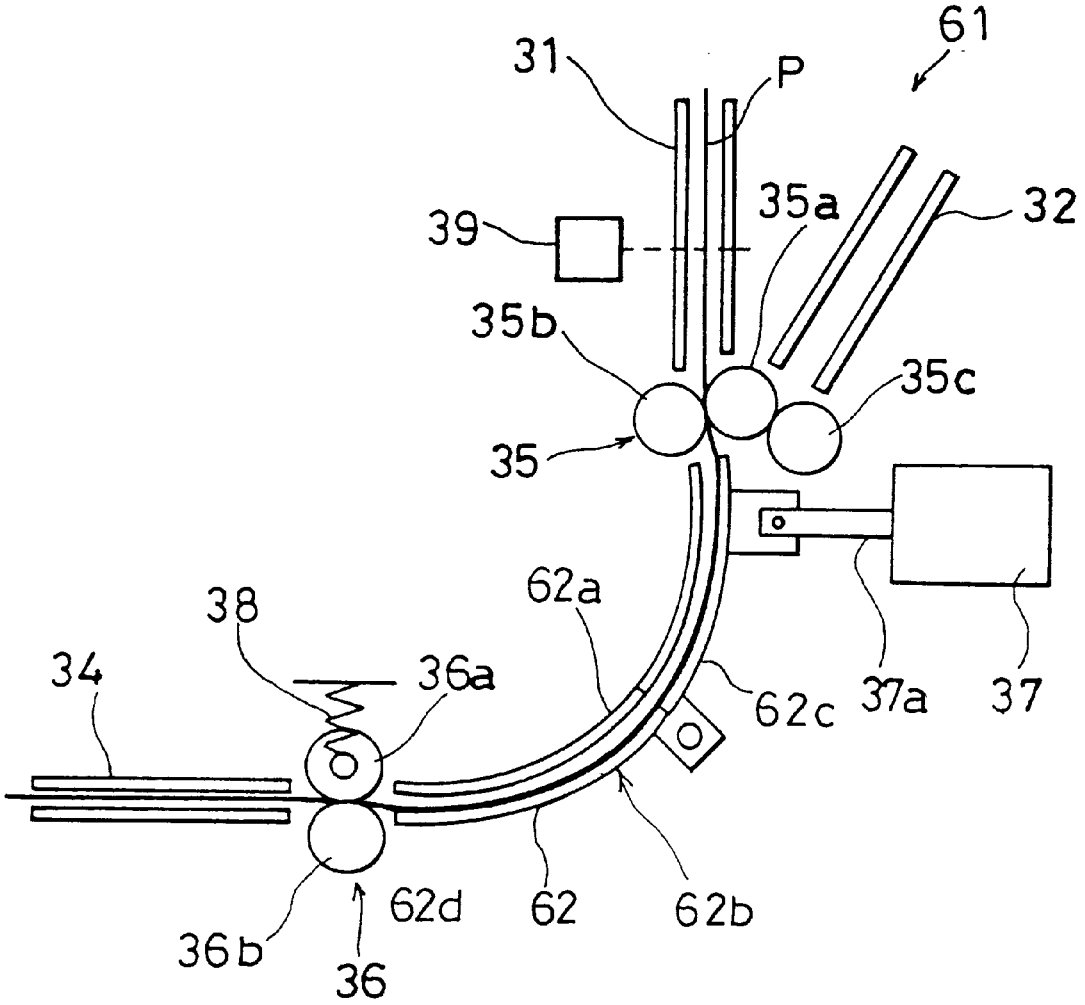
FIG. 12 is a schematic front view showing a paper-reversing device of still another embodiment of the present invention.

As illustrated in FIG. 12, the paper-reversing device 61 of the present embodiment is provided with a paper-reversing guide section 62 in place of the paper-reversing guide section 33 shown in FIG. 1. The paper-reversing guide section 62 has an inside guide section 62*a* and an outside guide section 62*b* that face each other, and the outside guide section 62*b* is divided into an upper guide section 62*c* functioning as the shift section and a lower guide section 62*d* in the vicinity of its mid-point. The upper guide section 62*c* is free to pivot on its lower end toward a paper-feeding position shown in FIG. 12 as well as toward a paper-sending position shown in FIG. 13. In order to actuate this pivotal movement, the leading edge of a plunger 37*a* in the solenoid 37 is connected to the upper portion of the upper guide section 62*c*.

Figure 4:
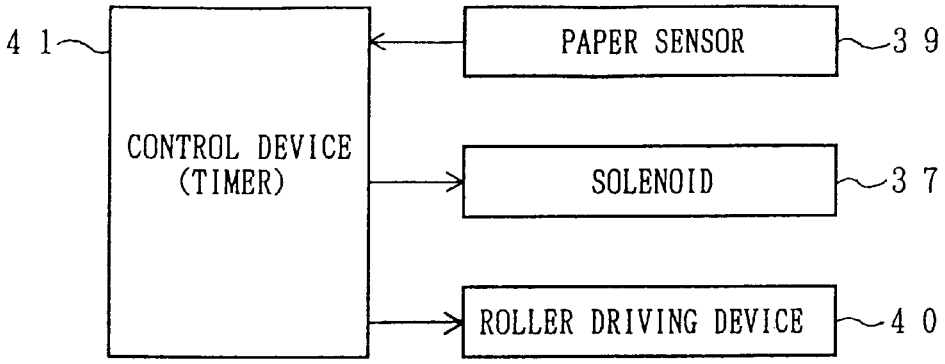
FIG. 4 is a block diagram which shows a structure of a control system of the paper-reversing device.

The construction of the control system of this paper-reversing device 61 is the same as that shown in FIG. 4. Further, the present paper-reversing device 61 is applied to a copying machine in the same manner as the paper-reversing device 17 shown in FIG. 2.

Figure 14:
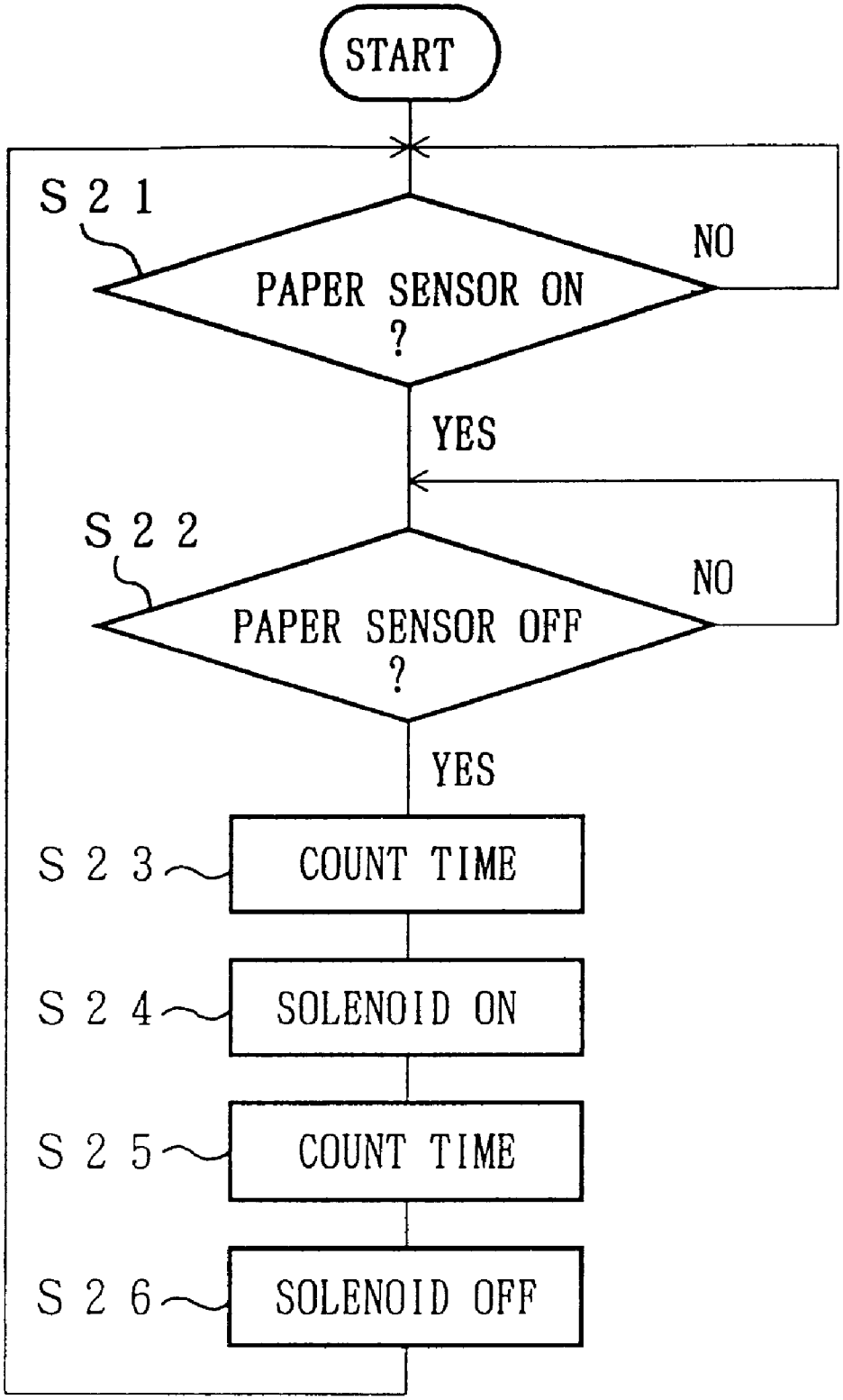
FIG. 14 is a flow chart showing the operation of the paper-reversing device of FIG. 12.

As shown in FIG. 12, in the present paper-reversing device 61 having the above-mentioned arrangement, in a state wherein the upper guide section 62*c* of the paper-reversing guide section 62 is placed at the paper-feeding position, when the paper P is passing through the paper sensor 39, the paper sensor 39 is turned on (S21), and then turned off (S22) in response to this movement, as shown in FIG. 14.

Figure 13:
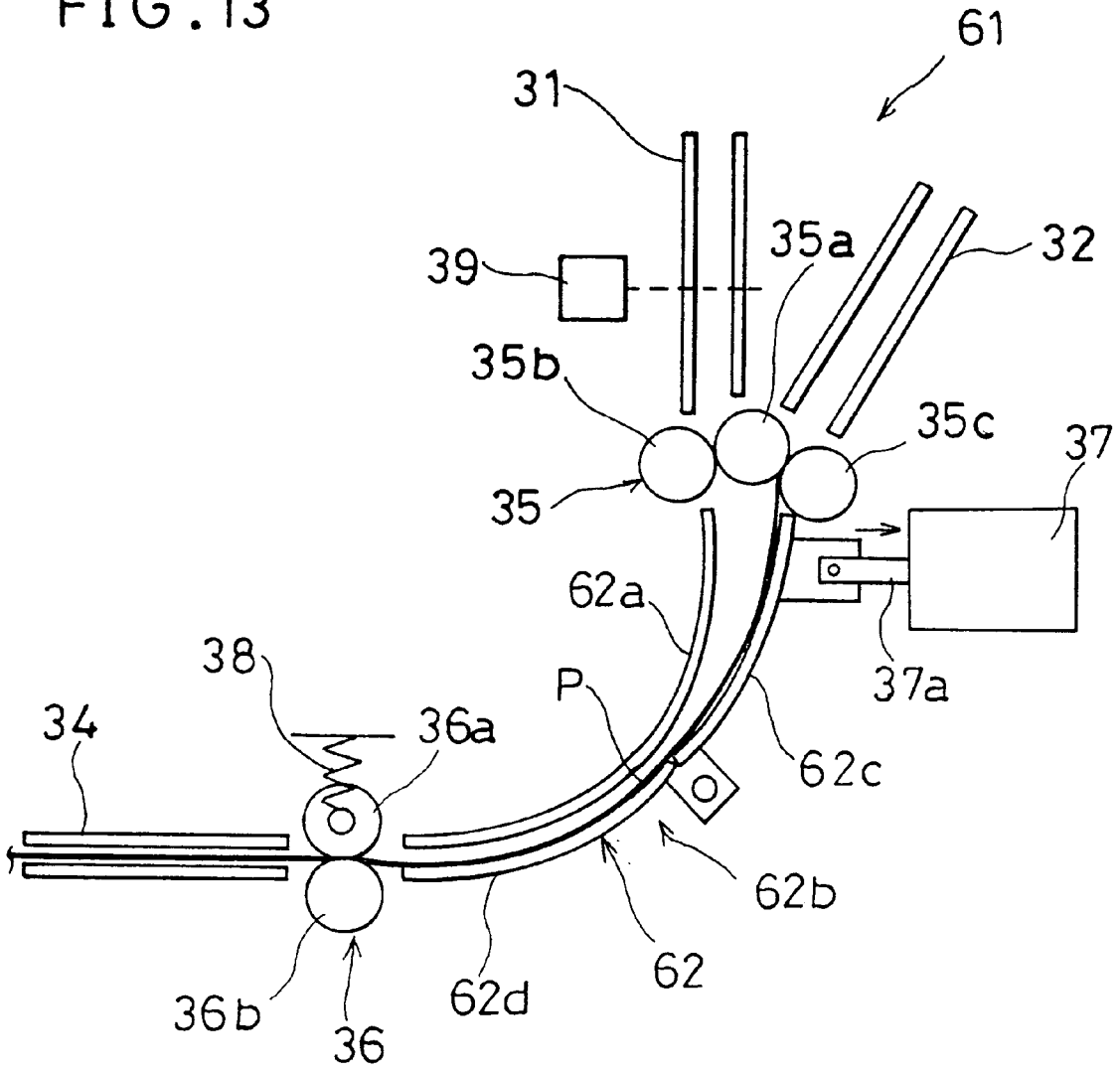
FIG. 13 is a schematic front view showing a paper-sending operation of the paper-reversing device of FIG. 12.

Thereafter, after completion of a predetermined time-counting operation made by the timer (S23), that is, after the rear end of paper P has passed between the paper-feeding driven roller 35*b* and the driving roller 35*a*, the control device 41 turns on the first solenoid 37 (S24). Thus, as shown in FIG. 13, only the upper guide section 62*c* of the paper-reversing guide section 62 is shifted to the paper-sending position, and the rear end of the paper P moves to a position between the driving roller 35*a* and the paper-sending driven roller 35*c* along the surface of the driving roller 35*a* by its own strength to straighten itself. Therefore, the paper P, the rear end of which is sucked between the driving roller 35*a* and the paper-sending driven roller 35*c*, is sent out through the paper-sending guide section 32 by the driving roller 35*a* and the paper-sending driven roller 35*c*.

Therefore, upon completion of a predetermined time-counting operation made by the timer after the turning-on of the solenoid 37 at S24 (S25), that is, after the paper P has passed through the paper-sending driven roller 35*c* and the driving roller 35*a*, the control device 41 turns off the solenoid 37 (S26). Here, the predetermined time at S25 can be set based on the transporting speed of the paper P. When the solenoid 37 is turned off, it is returned to the original state shown in FIG. 12 by a spring force, not shown. Consequently, the upper-guide section 62*c* is returned to the paper-feeding position shown in FIG. 12, thereby getting ready for the next paper.

Figure 15:
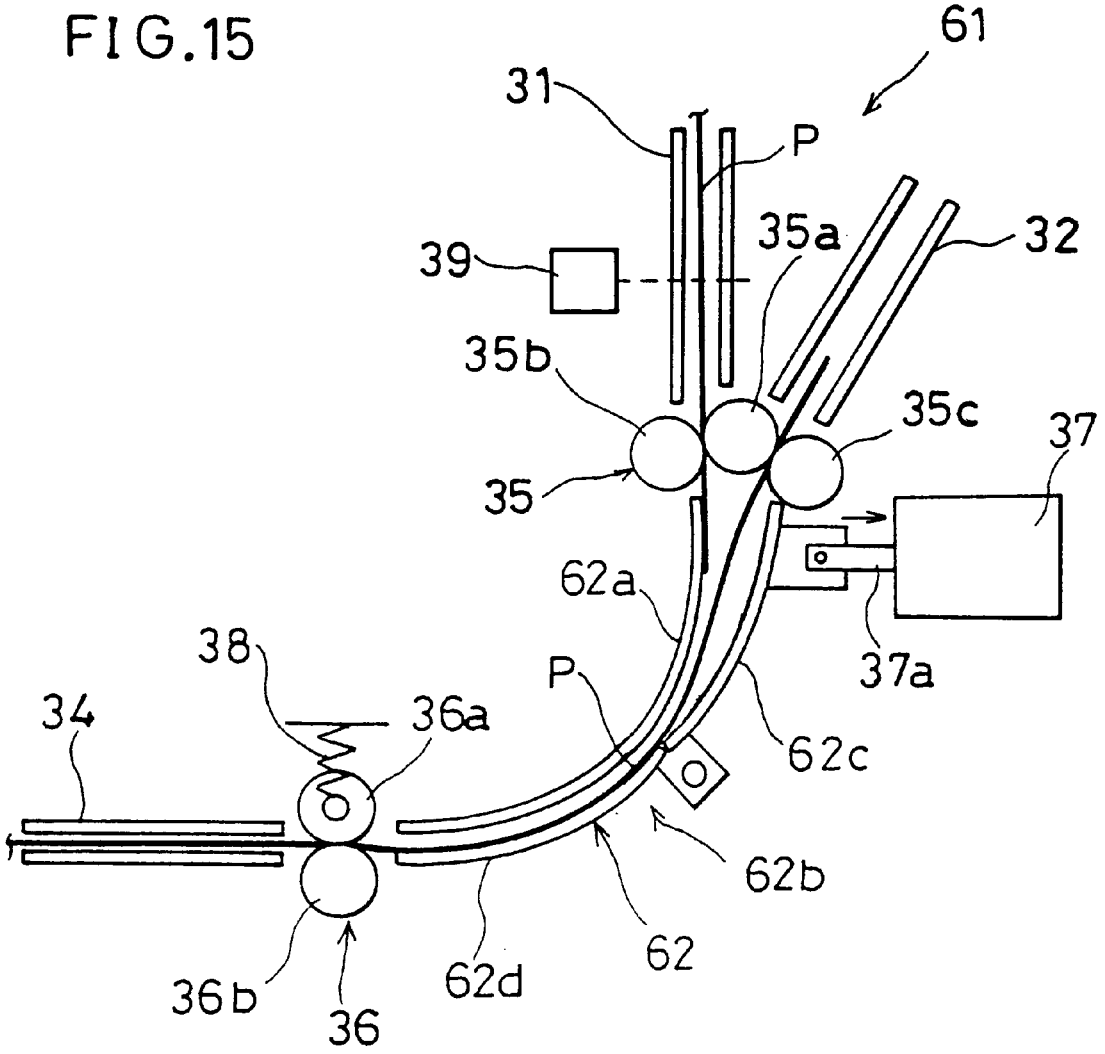
FIG. 15 is a schematic front view showing simultaneous paper-feeding and sending operations of the paper-reversing device of FIG. 12.

As shown in FIG. 15, in the present paper-reversing device 61, even in a state where the upper guide section 62*c* has been shifted to the paper-sending position, since the inside guide section 62*a* is in a fixed state at the paper-feeding position, it is possible to feed paper to the paper-reversing guide section 62 at the point when the end of the paper P that is to be preliminarily sent out is pinched between the driving roller 35*a* and the paper-sending driven roller 35*c*. Therefore, compared with the paper-reversing device 17 shown in FIG. 1 and the paper-reversing device 51 shown in FIG. 7, this arrangement makes it possible to shorten the transporting interval between sheets of paper by the period of time taken from the point when the end of the paper P that is to be preliminarily sent out is pinched between the driving roller 35*a* and the paper-sending driven roller 35*c* to the point when the paper-reversing guide section 33 or the paper-reversing guide section 52 has been returned to the original paper-feeding position.

[Embodiment 4]

Referring to FIGS. 16 through 19, the following description will discuss another embodiment of the present invention. Here, for convenience of explanation, those members that have the same functions and that are described in the aforementioned embodiment are indicated by the same reference numerals and the description thereof is omitted.

Figure 16:
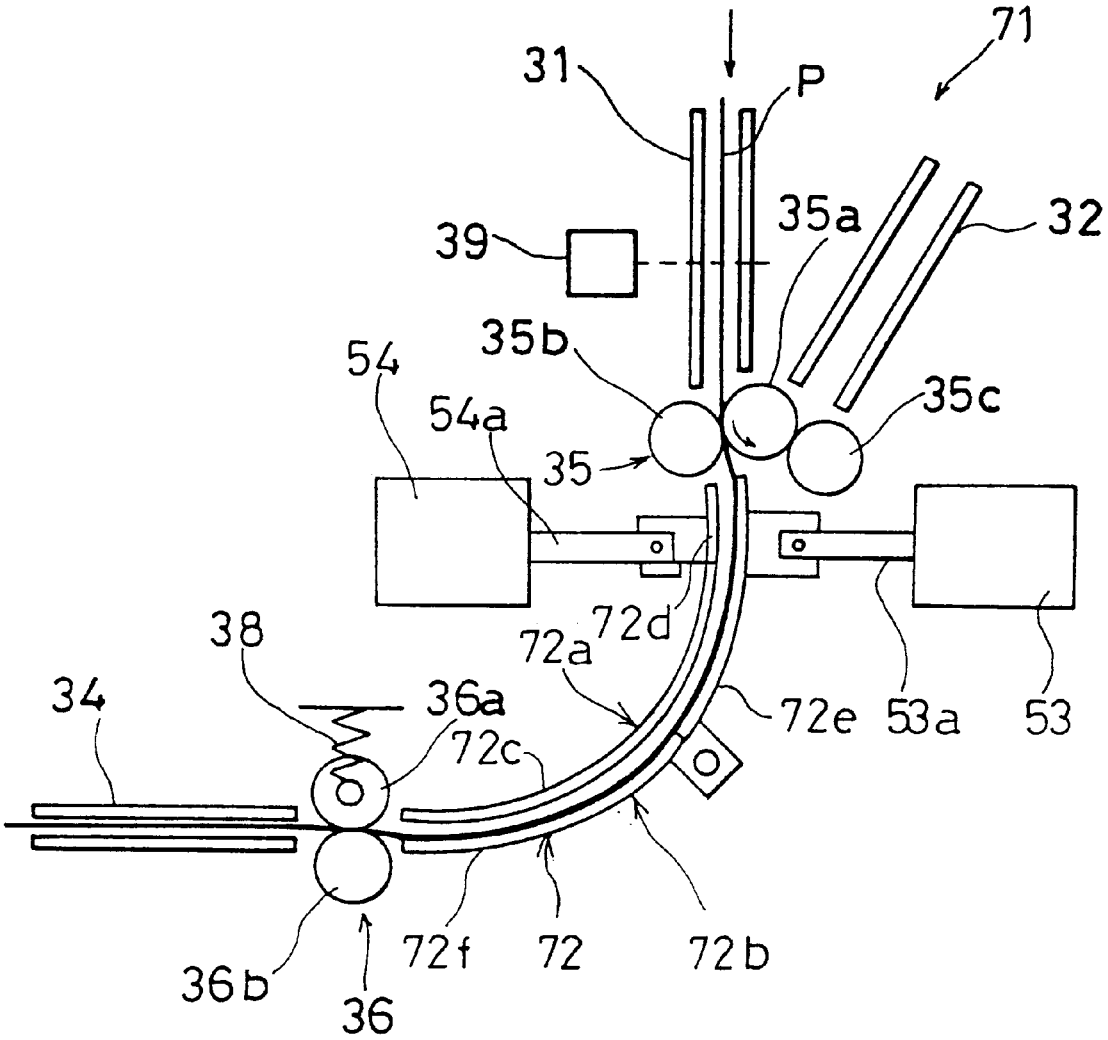
FIG. 16 is a schematic front view showing a paper-reversing device of still another embodiment of the present invention.

As illustrated in FIG. 16, the paper-reversing device 71 of the present embodiment is provided with a paper-reversing guide section 72 in place of the paper-reversing guide section 33 shown in FIG. 1. The paper-reversing guide section 72 has an inside guide section 72*a* and an outside guide section 72*b* that face each other. At its top portion, the outside guide section 72*a* is divided into an inside-guide main portion 72*c* and an inside-guide top portion 72*d* that functions as the shiftable paper-feeding and sending end. The outside guide section 72*b* is divided into an upper guide section 72*e* that functions as the shift section and an lower guide section 72*f* at the vicinity of its middle portion.

Figure 17:
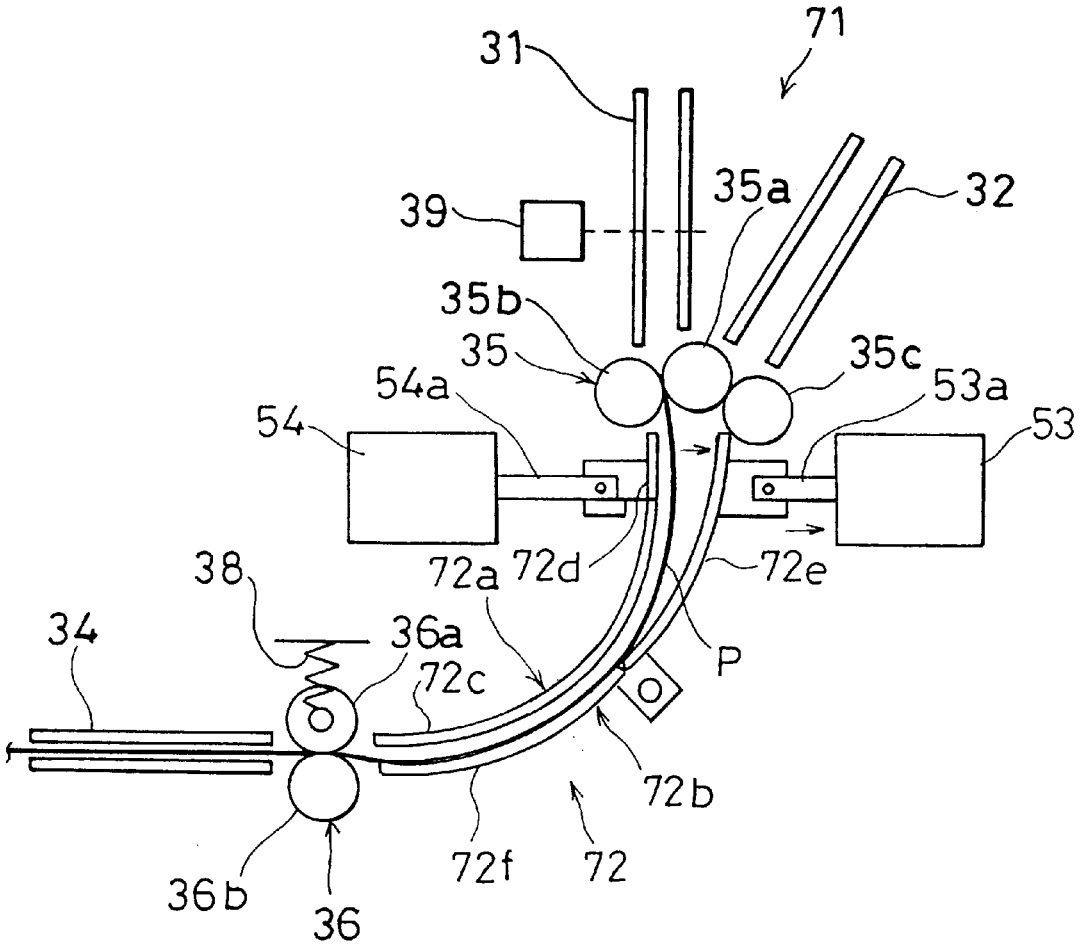
FIG. 17 is a schematic front view showing a transitional operation to a paper-sending operation of the paper-reversing device of FIG. 16.

The upper guide section 72*e* is free to pivot on its lower end toward a paper-feeding position shown in FIG. 16 as well as toward a paper-sending position shown in FIG. 17. In order to actuate this pivotal movement, the leading edge of a plunger 53*a* in the first solenoid 53 is connected to the upper portion of the upper guide section 72*e*. The first solenoid 53 allows the plunger 53*a* to retract to a state shown in FIG. 17 upon ON-operation, and also allows the plunger 53*a* to return to a state shown in FIG. 16 upon OFF-operation by the force of a spring, not shown.

Moreover, the inside-guide top portion 72*d* is separated from the inside-guide main portion 72*c* so that it can carry out operations in a separate manner from the inside-guide main portion 72*c*. For this purpose, the inside-guide top portion 72*d* is attached to the top of the plunger 54*a* in the second solenoid 54. The second solenoid 54 is installed on the side opposite to the first solenoid 53 with respect to the paper-reversing guide section 72 so that the shift direction of the plunger 54*a* is set in parallel with the shift direction of the plunger 53*a* of the first solenoid 53. The actions of the first and second solenoids 53 and 54 are controlled by a control device 55 shown in FIG. 10. Further, the present paper-reversing device 71 is applied to a copying machine in the same manner as the paper-reversing device 17 shown in FIG. 2.

Figure 19:
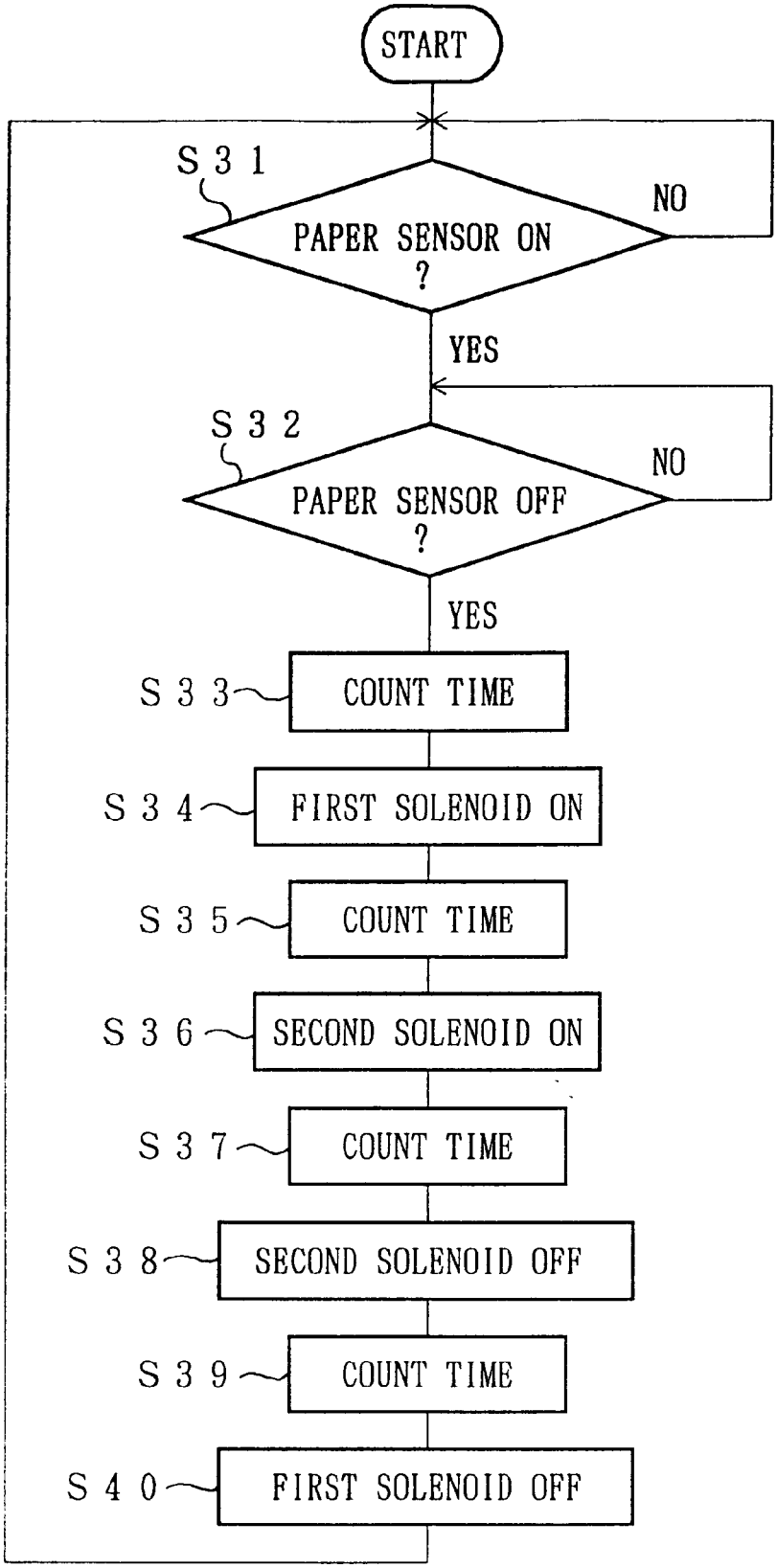
FIG. 19 is a flow chart showing the operation of the paper-reversing device of FIG. 16.

As shown in FIG. 16, in the present paper-reversing device 71 having the above-mentioned arrangement, in a state wherein the inside-guide top portion 72*d* of the inside-guide section 72*a* and the upper guide section 72*e* of the outside guide section 72*b* of the paper-reversing guide section 72 are placed at the paper-feeding position, when paper P is passing through the paper sensor 39, the paper sensor 39 is turned on (S31), and then turned off (S32) in response to this movement, as shown in FIG. 19.

Thereafter, after completion of a predetermined time-counting operation made by the timer (S33), that is, after the rear end of paper P has passed between the paper-feeding driven roller 35*b* and the driving roller 35*a*, the control device 55 turns on the first solenoid (S34). Thus, as shown in FIG. 17, the upper guide section 72*e* of the outside guide section 72*b* is shifted to the paper-sending position.

Figure 18:
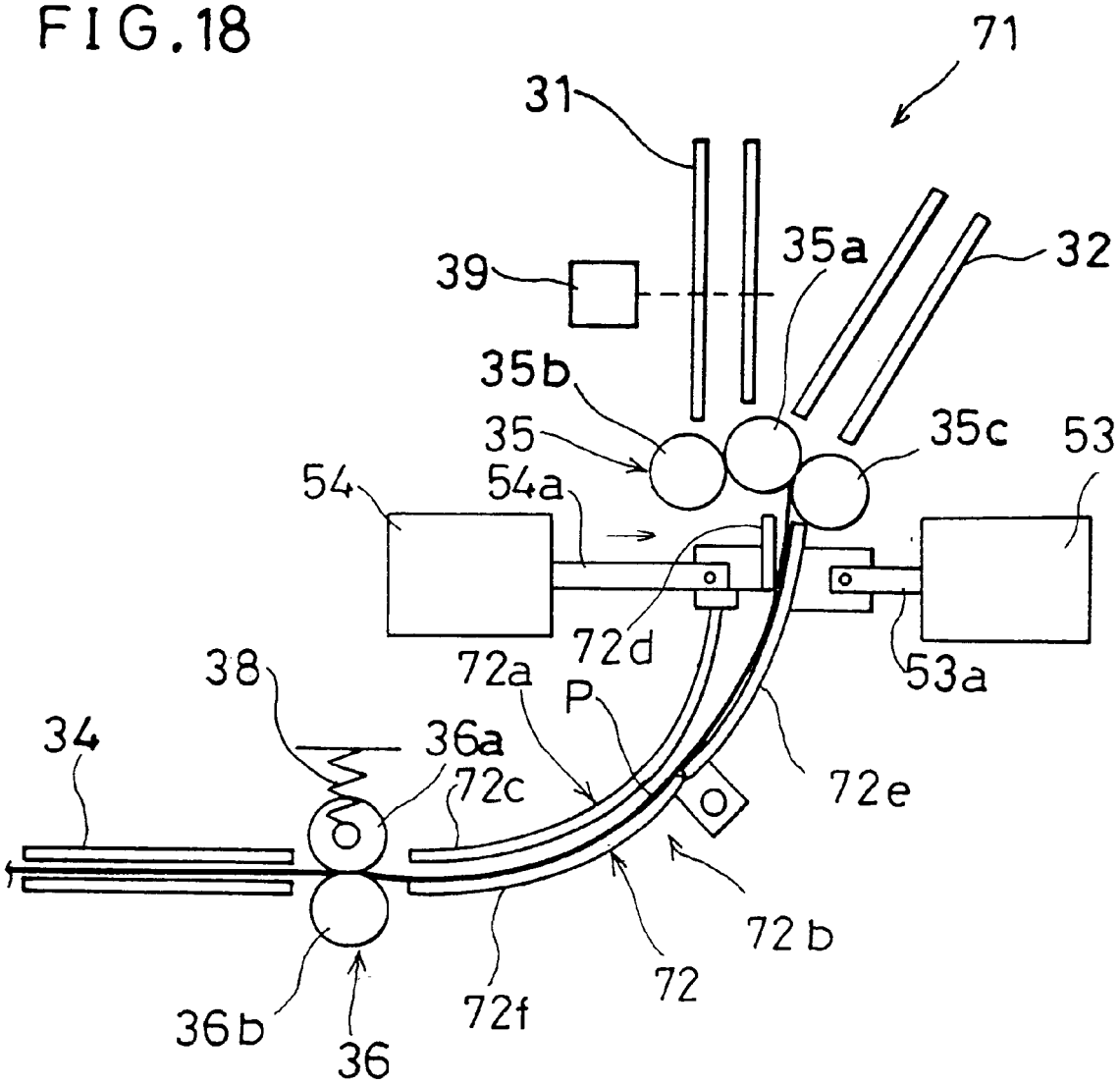
FIG. 18 is a schematic front view showing a paper-sending operation of the paper-reversing device of FIG. 16.

Next, upon completion of a predetermined time-counting operation made by the timer (S35), that is, after completion of the shift of the upper guide section 72*e* activated by the turning-on of the first solenoid 53, the control device 55 turns on the solenoid 54 (S36). Thus, as shown in FIG. 18, the inside-guide top portion 72*d* of the inside guide section 72*a* is shifted to the paper-sending position so that the rear end of the paper P, which is pushed by the inside-guide top portion 72*d*, moves to a position between the driving roller 35*a* and the paper-sending driven roller 35*c* along the surface of the driving roller 35*a*. Thereafter, the paper P, the rear end of which has been sucked between the driving roller 35*a* and the paper-sending driven roller 35*c* because of its strength to straighten itself, is sent out through the paper-sending guide section 32 by the driving roller 35*a* and the paper-sending driven roller 35*c*.

Moreover, after having turned on the second solenoid 54 at S36, the control device 55 waits until the timer has completed a predetermined time-counting operation (S37), that is, until the inside-guide top portion 72*d*, actuated by the ON-operation of the second solenoid 54, has been shifted to the paper-sending position, and then turns off the second solenoid guide 54 (S38). Thus, the inside-guide top portion 72*d*, that is, the inside guide section 72*a* is returned to the state shown in FIG. 17.

Thereafter, the control device 55 waits until the timer has completed a predetermined time-counting operation (S39), and turns off the first solenoid 53. In this case, the predetermined time corresponds to the time taken from the point when the second solenoid 54 was turned on at S36 to the point when the paper P has passed between the driving roller 35*a* and the paper-sending driven roller 35*c*. Thus, the upper guide section 72*e*, that is the outside guide section 72*b*, is returned to the state shown in FIG. 16.

When sending the paper P, the present paper-reversing device 71 forcefully shifts the rear end of the paper P to reach between the paper-sending driven roller 35*c* and the driving roller 35*a* by using the inside-guide top portion 72*d*. This arrangement further ensures a positive paper-sending operation of the paper P.

Moreover, the inside-guide top portion 72*d* is promptly returned to the paper-feeding position after completion of its shift to the paper-sending position. Therefore, in a manner similar to the paper-reversing device 61 described in FIG. 15, it is possible to feed a sheet of paper to the paper-reversing guide section 72 at the point when the paper P that is to be preliminarily sent has its rear end pinched between the driving roller 35*a* and the paper-feeding driven roller 35*c*. Therefore, compared with the paper-reversing device 17 shown in FIG. 1 and the paper-reversing device 51 shown in FIG. 7, this arrangement makes it possible to shorten the transporting interval between sheets of paper by the period of time taken from the point when the end of the paper P that is to be preliminarily sent out is pinched between the driving roller 35*a* and the paper-sending driven roller 35*c* to the point when the paper-reversing guide section 33 or the paper-reversing guide section 52 has been returned to the original paper-feeding position.

[Embodiment 5]

Referring to FIGS. 20 through 25, the following description will discuss another embodiment of the present invention. Here, for convenience of explanation, those members that have the same functions and that are described in the aforementioned embodiment are indicated by the same reference numerals and the description thereof is omitted.

The paper-reversing device 81 of the present embodiment is provided with a paper-holding roller device 82 (paper-holding means) in place of the paper-holding roller device 36 in paper-reversing device 17 of FIG. 1 in the aforementioned Embodiment 1. Here, an upper roller 82*a* and a lower roller 82*b* respectively correspond to the upper roller 36*a* and the lower roller 36*b*.

Figure 23:
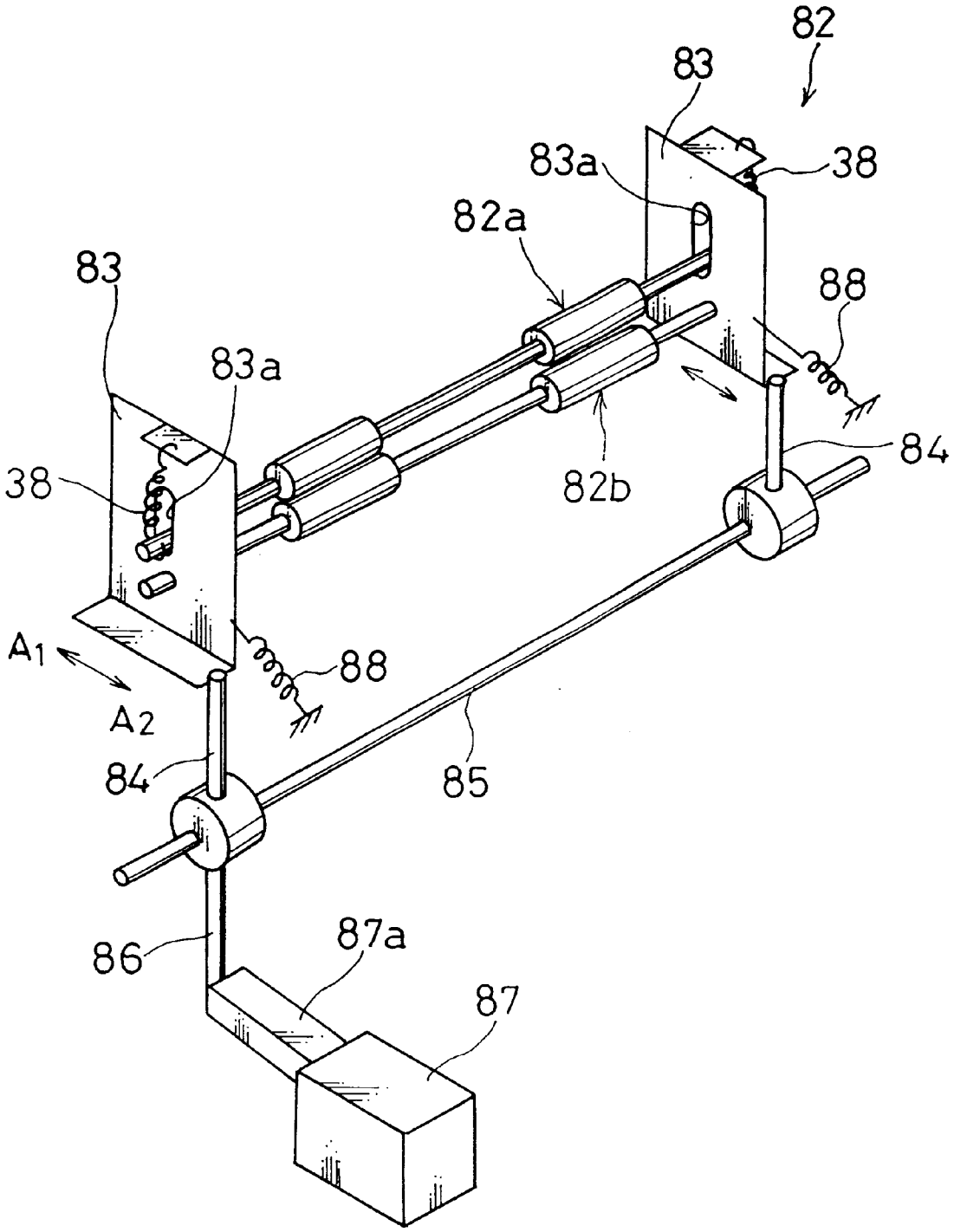
FIG. 23 is a schematic perspective view showing a paper-holding roller device that is shown in FIG. 20.
Figure 24:
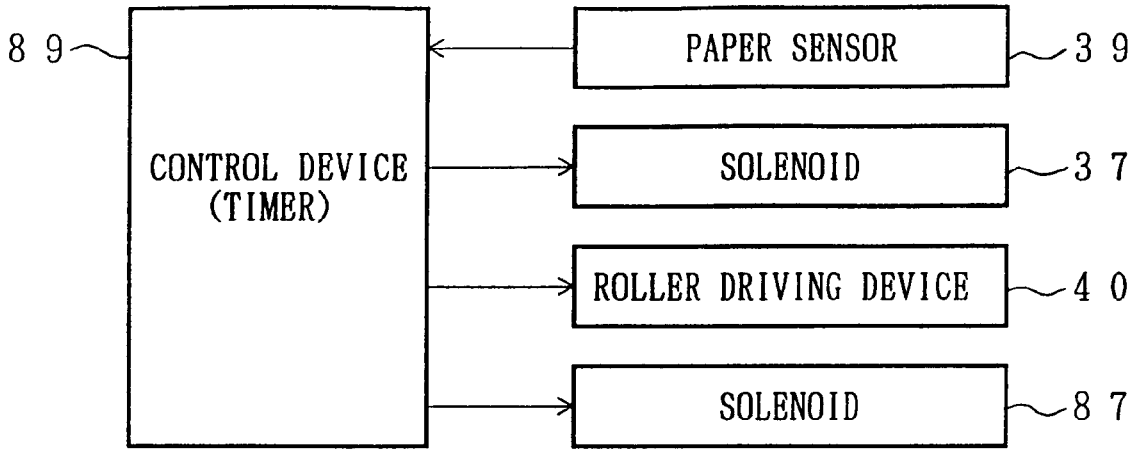
FIG. 24 is a block diagram showing a structure of a control system of the paper-reversing device of FIG. 20.

As shown in FIG. 23, in the paper-holding roller device 82, the upper roller 82*a* and the lower roller 82*b* are attached to support plates 83 on both sides thereof so as to rotate freely. The upper roller 82*a*, which is attached through slotted holes 83*a* formed in the support plates 83 in the longitudinal (upward and downward) direction, is allowed to freely move in the longitudinal direction, and pressed against the lower roller 82*b* by its dead weight. Further, as described earlier, the upper roller 82*a* is suspended from the upper portions of the support plates 83 by springs 38 so as to adjust its pressing force.

The two support plates 83 are allowed to freely advance and retreat in directions indicated by arrows $A_1$ and $A_2$ shown in FIG. 23, with a predetermined interval kept from each other. Each support plate 83 engages an interaction rod 84, and the interaction rod 84 is attached to a rotary shaft 85 that is fixed so as to freely rotate. The rotary shaft 85 is coupled to a plunger 87*a* of a solenoid 87 by a coupling rod 86. Thus, when the solenoid 87 is turned on, the plunger 87*a* retreats and the rotary shaft 85 rotates, causing the support plates 83 to be pushed in the $A_1$ direction by the interaction rods 84 so that the two support plates 83 are shifted in the $A_1$ direction. Here, the support plates 83 are pulled by springs 88 in the $A_2$ direction. Thus, when the solenoid 87 is turned off and the plunger 87*a* is returned to its advanced state, the support plates 83 are returned in the $A_2$ direction to the original positions. The solenoid 87 is controlled by a control device 89 shown in FIG. 24.

Figure 20:
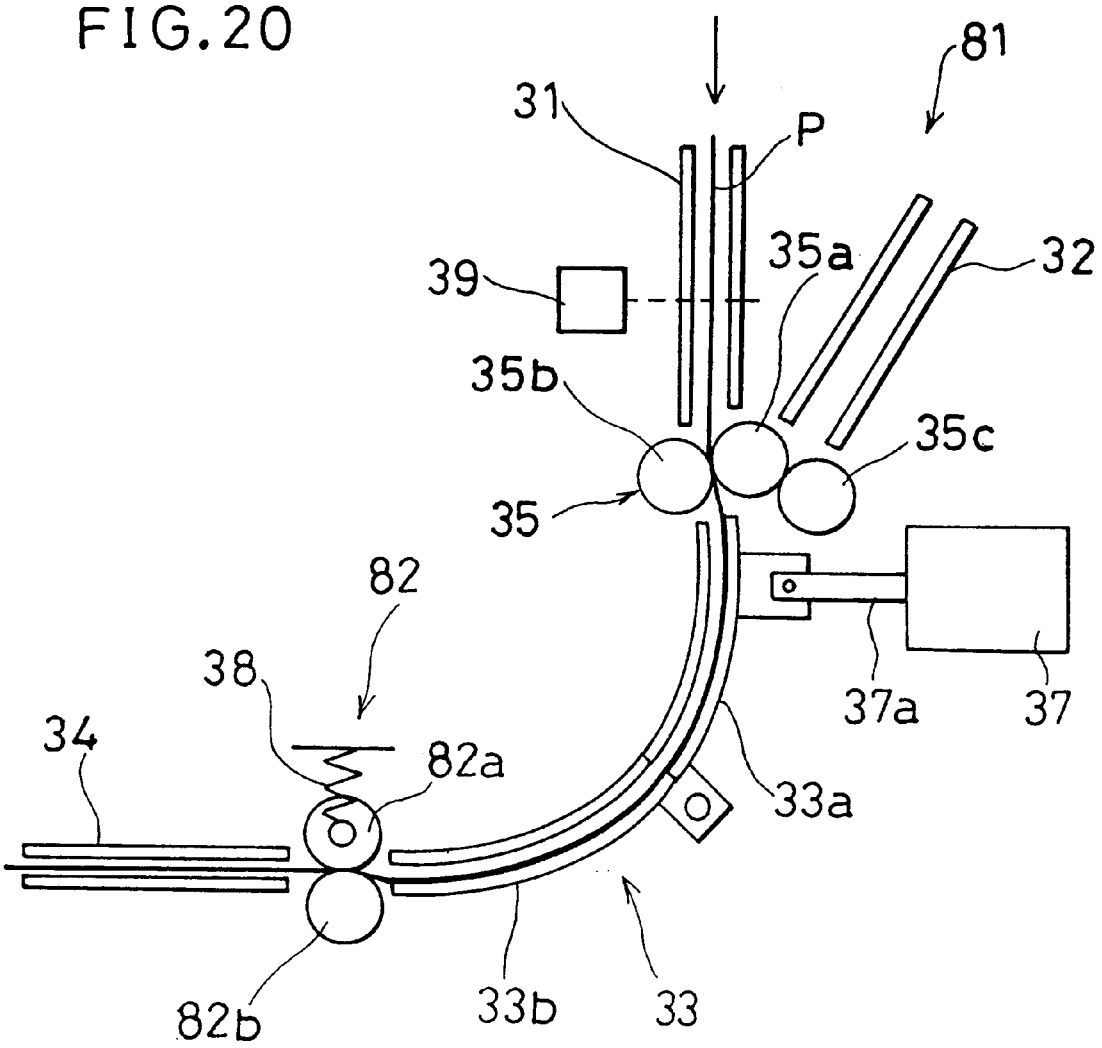
FIG. 20 is a schematic front view showing a paper-reversing device of still another embodiment of the present invention.
Figure 25:
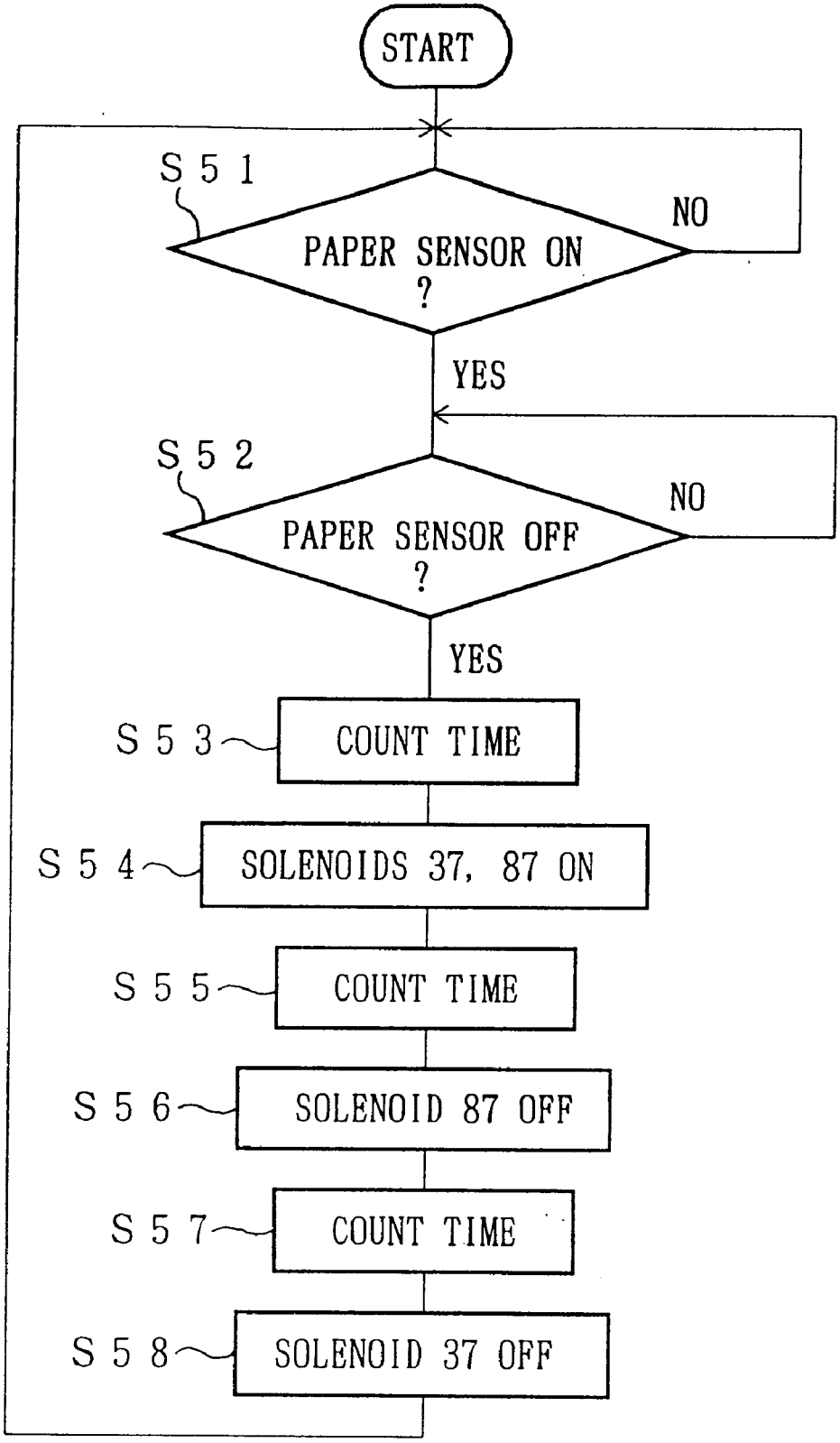
FIG. 25 is a flow chart showing an operation of the paper-reversing device of FIG. 20.

As illustrated in FIG. 20, in the present paper-reversing device 81 having the above-mentioned arrangement, when the paper P is passing through the paper sensor 39 in a state where the upper guide section 33*a* of the paper-reversing guide section 33 is placed at the paper-feeding position, the paper sensor 39 is turned on (S51), as shown in FIG. 25, in response to this movement, and then is turned off (S52).

Figure 21:
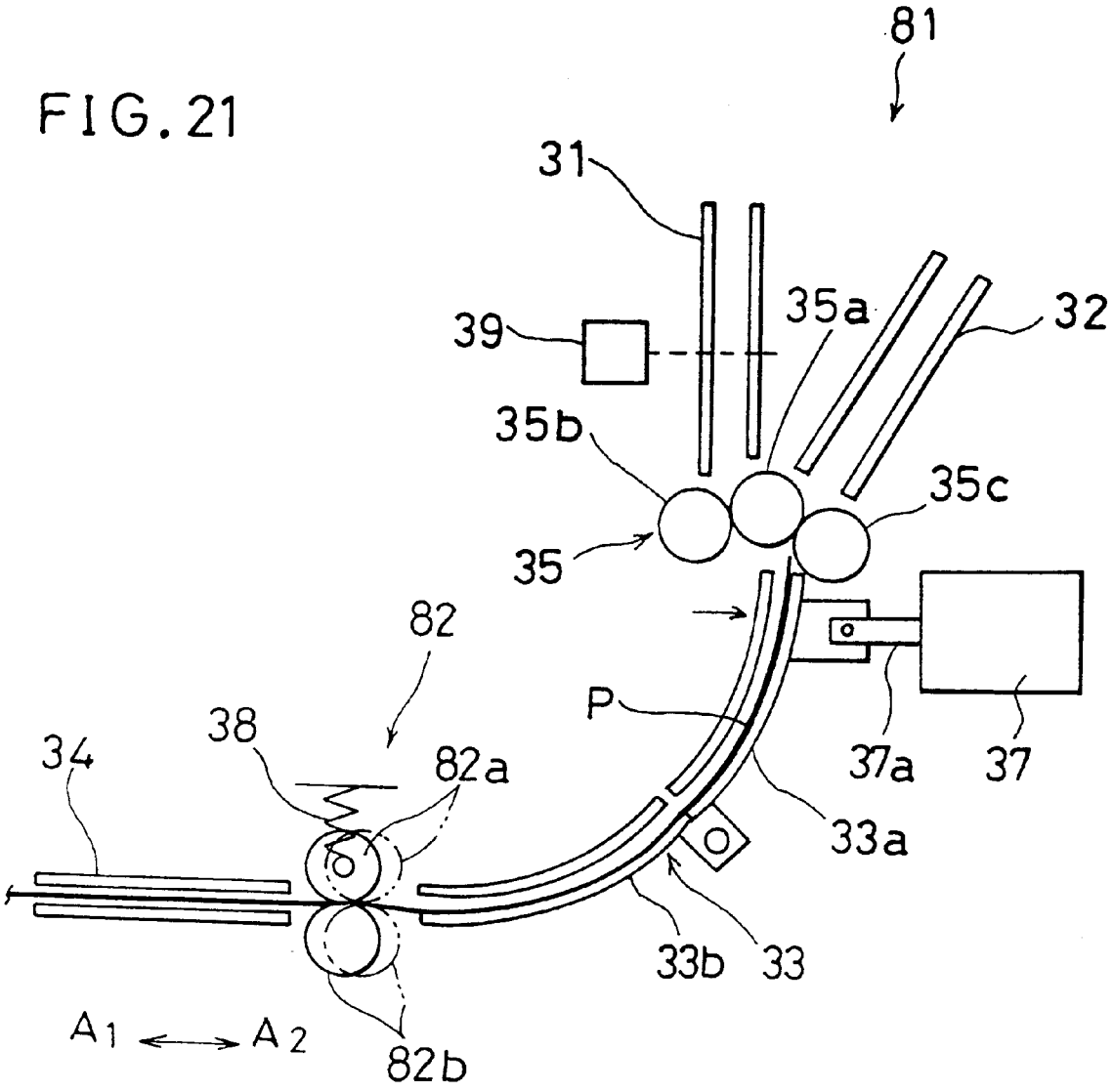
FIG. 21 is a schematic front view showing the first-step operation in the paper-sending operation of the paper-reversing device of FIG. 20.

Thereafter, the control device 89 waits until the timer has completed a predetermined time-counting operation (S53), that is, until the rear end of the paper P has passed between the paper-feeding driven roller 35*b* and the driving roller 35*a*, and turns on the two solenoids 37 and 87 (S54). Thus, as shown in FIG. 21, the upper guide section 33*a* of the paper-reversing guide section 33 is shifted to the paper-sending position. Further, the upper and lower rollers 82*a* and 82*b* of the paper-holding roller device 82 are shifted in the $A_1$ direction.

When the upper guide section 33*a* has been shifted to the paper-sending position, the rear end of the paper P moves to a position between the driving roller 35*a* and the paper-sending driven roller 35*c* along the surface of the driving roller 35*a* because of its own strength to straighten itself. Moreover, when the upper and lower rollers 82*a* and 82*b* are shifted in the $A_1$ direction, the paper P is shifted in the $A_1$ direction following this movement, and the rear end of the paper P separates from a bottom position that is a position between the paper-feeding driven roller 35*b* and the driving roller 35*a*. Therefore, the rear end of the paper P readily moves to a position between the driving roller 35*a* and the paper-feeding driven roller 35*c*.

Next, after having turned on the solenoid 87 at S54, the control device 89 waits until the timer has completed a predetermined time-counting operation (S55), and then turns off the solenoid 87 (S56). The predetermined time corresponds to the time taken from the ON operation of the solenoid 87 to the point when the upper and lower rollers 82*a* and 82*b* have been shifted to the positions in the $A_1$ direction.

Figure 22:
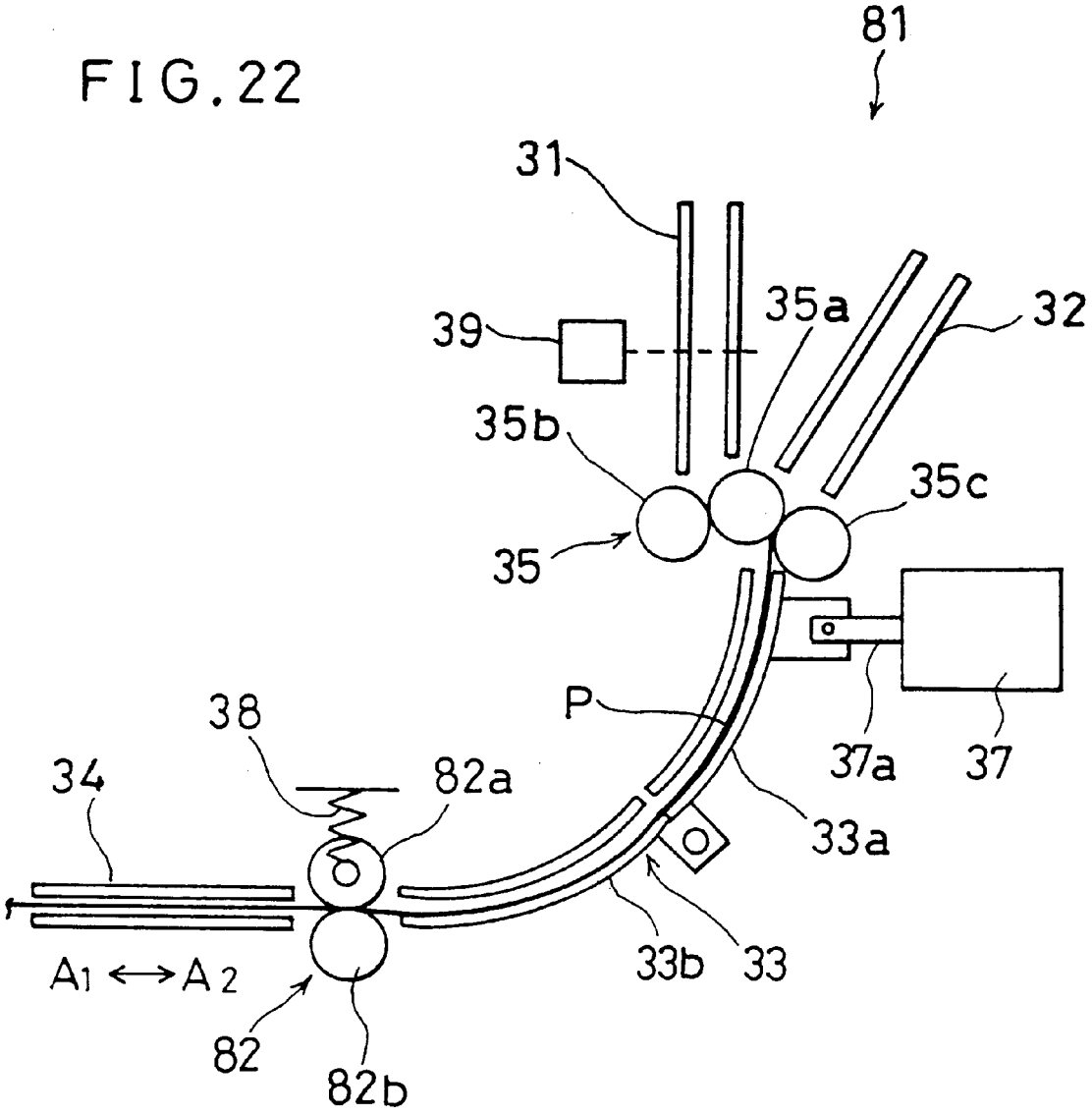
FIG. 22 is a schematic front view showing the second-step operation in the paper-sending operation of the paper-reversing device of FIG. 21.

When the solenoid 87 has been turned off, the upper and lower rollers 82*a* and 82*b* are returned to the original positions in the $A_2$ direction, as shown in FIG. 22. Following these movements, the paper P is returned in the $A_2$ direction, and the rear end of the paper P comes into contact with a position between the driving roller 35*a* and the paper-sending driven roller 35*c*. Therefore, the paper P is sucked between the driving roller 35*a* and the paper-sending driven roller 35*c*, and sent out through the paper-sending guide section 32.

Thereafter, the control device 89 waits until the timer has completed a predetermined time-counting operation (S57), that is, until the paper P has been pinched between the driving roller 35*a* and the paper-sending driven roller 35*c*, and then turns off the solenoid 37. Thus, the upper guide section 33*a* is returned to the state shown in FIG. 20.

When shifting the upper guide section 33*a* from the paper-feeding position to the paper-sending position, the present paper-reversing device 81 moves the upper and lower rollers 82*a* and 82*b* of the paper-holding roller device 82 in such a direction that the paper P separates from the triple-roller device 35, thereby allowing the rear end of the paper P to easily move to a position between the driving roller 35*a* and the paper-sending driven roller 35*c*. This arrangement further ensures a positive paper-sending operation of the paper P.

Additionally, the arrangement of the paper-holding roller device 82, shown in the present embodiment, is not only applied to the paper-reversing device 17 described in Embodiment 1, but also applied to the paper-reversing devices 51, 61 and 71 described in Embodiments 2 through 4.

[Embodiment 6]

Referring to FIGS. 26 through 33, the following description will discuss another embodiment of the present invention. Here, for convenience of explanation, those members that have the same functions and that are described in the aforementioned embodiment are indicated by the same reference numerals and the description thereof is omitted.

Figure 26:
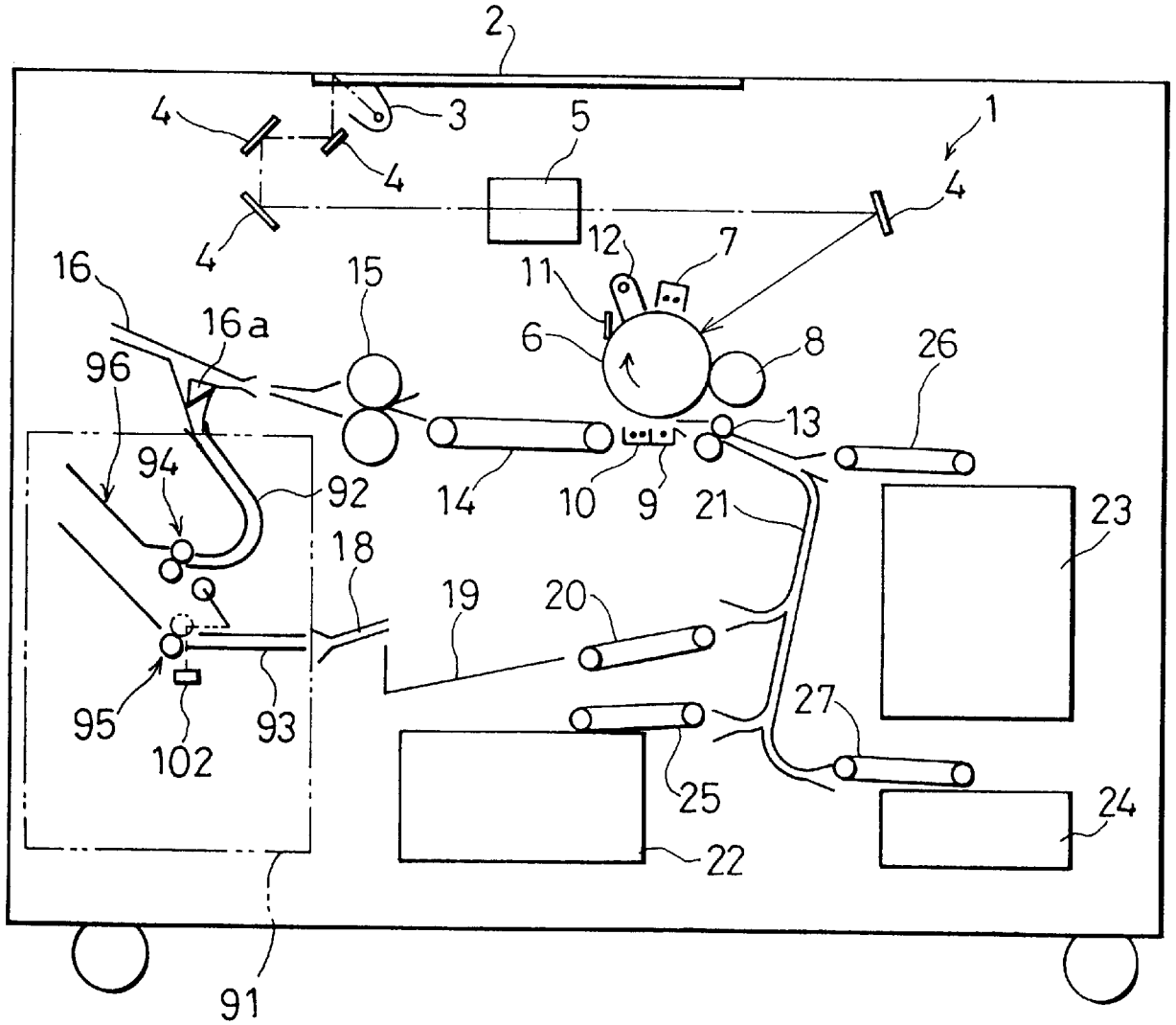
FIG. 26 is a schematic front view which shows an internal structure of a copying machine in which a paper-reversing device of still another embodiment of the present invention is installed.
Figure 27:
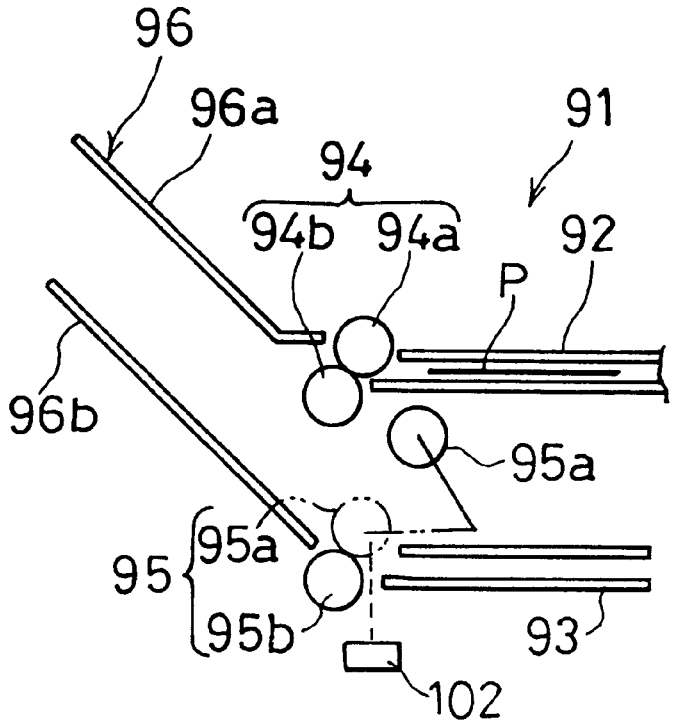
FIG. 27 is a schematic front view showing a structure of the paper-reversing device of FIG. 26.

As illustrated in FIG. 26, the paper-reversing device 91 of the present embodiment is provided with a paper-feeding guide section 92 that is connected to the switching unit 16 and a paper-sending guide section 93 that is connected to the paper guide 18. As illustrated in FIG. 27, at a paper-sending position from the paper-feeding guide section 92 is installed a paper-feeding roller device 94 that consists of an upper paper-feeding roller 94*a* and a lower paper-feeding roller 94*b* and that functions as a paper-feeding transport means. One of the upper paper-feeding roller 94*a* and the lower paper-feeding roller 94*b* is a driving roller and the other thereof is a driven roller. Further, at a paper-feeding position to the paper-sending guide section 93 is installed a paper-sending roller device 95 that consists of an upper paper-sending roller 95*a* and a lower paper-sending roller 95*b* and that functions as a paper-sending roller means.

A paper-reversing guide 96 (paper-reversing guide section) is installed on the paper-sending side of the paper-feeding roller device 94. The paper-reversing guide 96 consists of an upper guide section 96*a* and a lower guide section 96*b*. The upper guide section 96*a* is installed at a paper-sending position from the paper-feeding roller device 94 and the lower guide section 96*b* is installed at a paper-feeding position to the paper-sending roller device 95. The lower guide section 96*b*, which has a lower end on the paper-sending roller device 95 side, tilts in such a manner that paper P, placed onto the lower guide section 96*b*, slides in a direction toward the paper-sending roller device 95, and is situated on the lower paper-sending roller 95*b*. The guide section 96*a* is disposed virtually in parallel with the upper guide section 96*b*.

Figure 31:
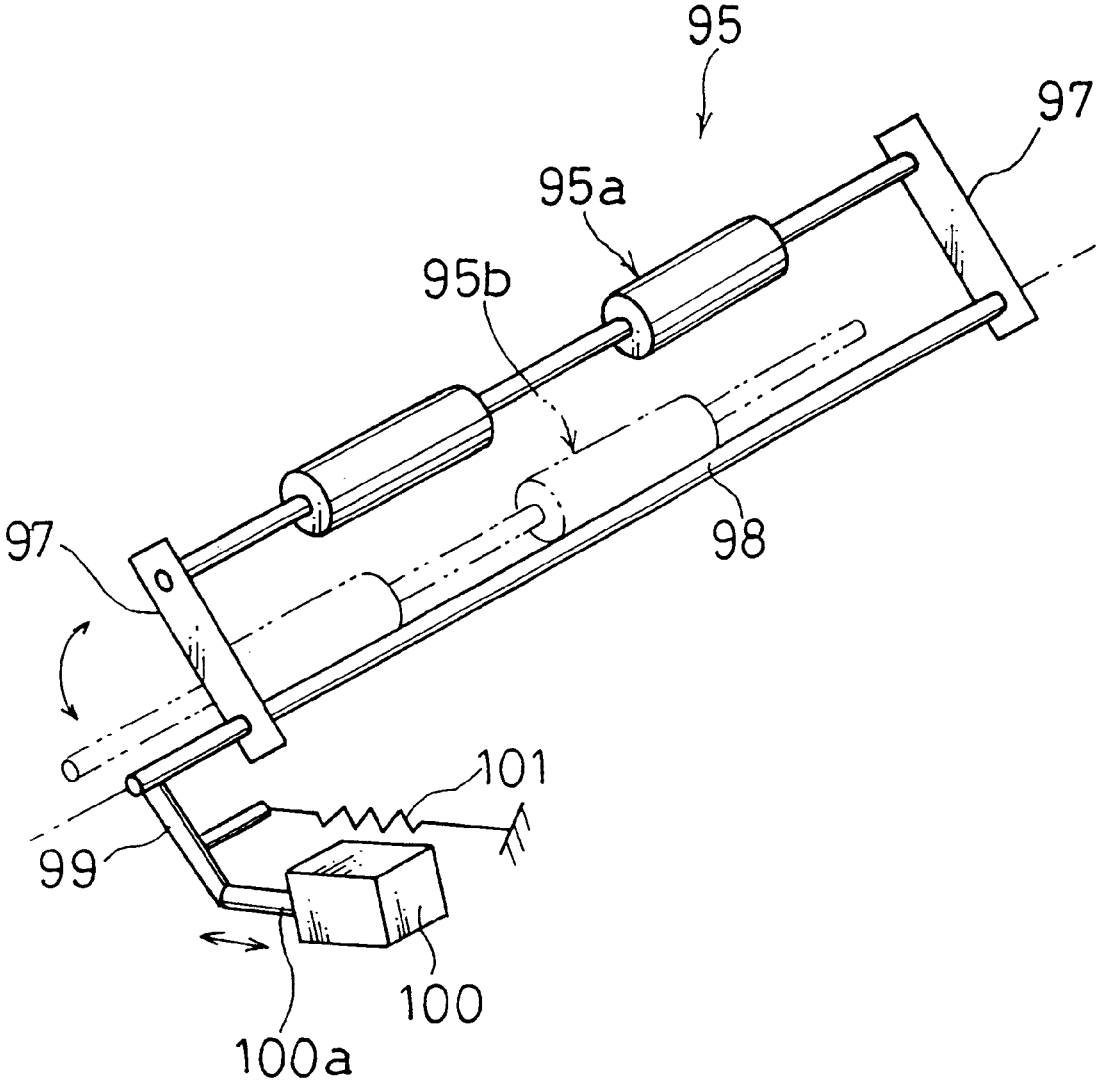
FIG. 31 is a schematic perspective view showing a paper-sending roller device that is shown in FIG. 27.
Figure 32:
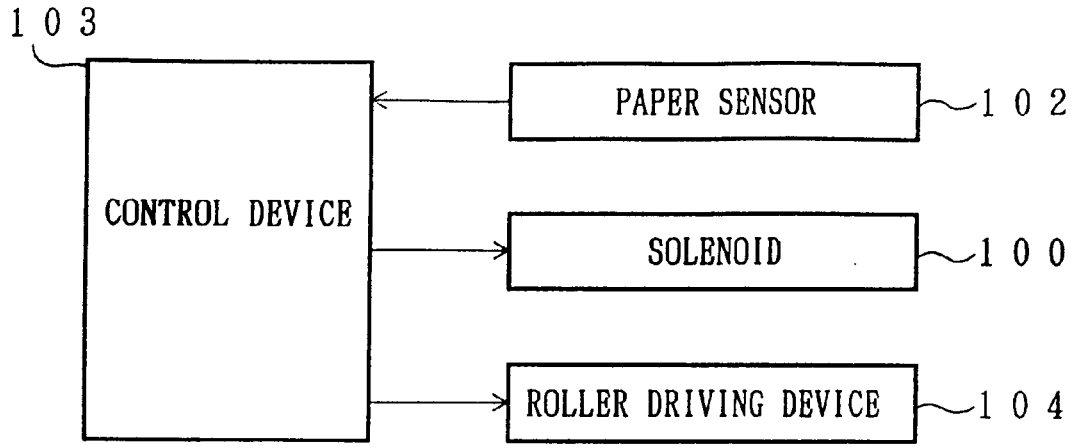
FIG. 32 is a block diagram showing a structure of a control system of the paper-reversing device of FIG. 27.

As illustrated in FIG. 31, in the paper-sending roller device 95, the upper paper-sending roller 95*a* is attached to a rotary shaft 98 that is fixed so as to freely rotate, through support rods 97. The rotary shaft 98 is coupled to a plunger 100*a* of a solenoid 100 by a coupling rod 99. Thus, when the solenoid 100 is turned on, the plunger 100*a* advances to rotate the rotary shaft 98, causing the upper paper-sending roller 95*a* to shift upward and separate from the lower paper-sending roller 95*b*. Further, the coupling rod 99 is pulled in such a direction as to retract the plunger 100*a* by a spring 101. Therefore, when the solenoid 100 is turned off and the plunger 100*a* is returned to its retracted state, the upper paper-sending roller 95*a* is pressed against the lower paper-sending roller 95*b*. Here, the solenoid 100 and the spring 101 constitute a roller-shifting means.

A paper sensor 102 detects whether or not the paper P has reached the lower paper-feeding roller 95*b*. A control device 103, shown in FIG. 32, controls the operation of the solenoid 100 in accordance with the detection that has been made by the paper sensor 102. The control device 103 further controls a roller driving device 104 for rotatably driving the driving roller of the paper-feeding roller device 94 and the lower paper-sending roller 95*b*.

In the above-mentioned arrangement, when the paper P, which has been subjected to a one-sided copying process, is fed to the paper-feeding guide section 92 of the paper-reversing device 91 through the switching unit 16, the upper paper-sending roller 95*a* of the paper-sending roller device 95 is separated from the lower paper-sending roller 95*b* and placed at a refuge position located above, as shown in FIG. 27. At this time, the solenoid 100 is in the ON state and the plunger 100*a* is in the advanced state.

Figure 28:
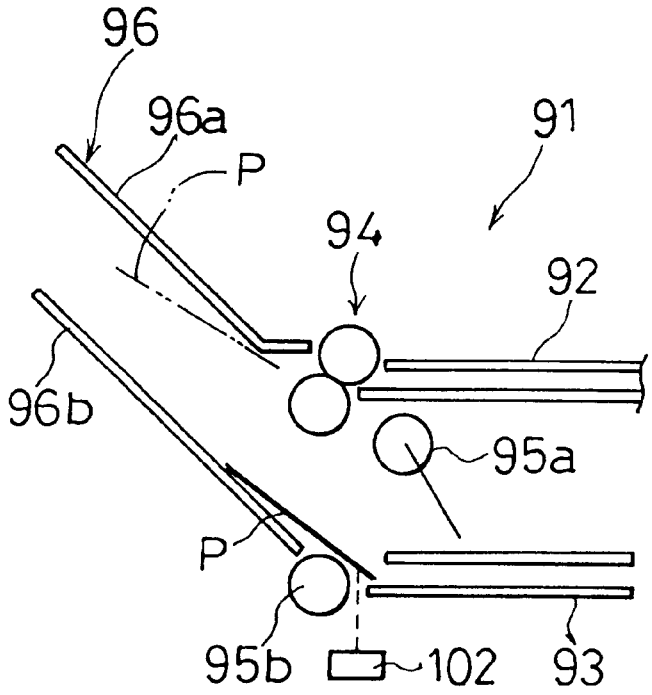
FIG. 28 is a schematic front view showing the first-step operation in the paper-sending operation of the paper-reversing device of FIG. 26.

As shown in FIG. 28, the paper P, which has entered the paper-feeding guide section 92, is fed into the paper-reversing guide 96 by the paper-feeding roller device 94. In this case, the paper P proceeds through the paper-reversing guide 96 at a transporting speed that is given by the paper-feeding roller device 94. Thereafter, the paper P drops onto the lower guide section 96*b*, slides over the lower guide section 96*b* due to its dead weight, and reaches the lower paper-sending roller 95*b*. This state is detected by the paper sensor 102, and the output of the paper sensor 102 is turned on.

Figure 29:
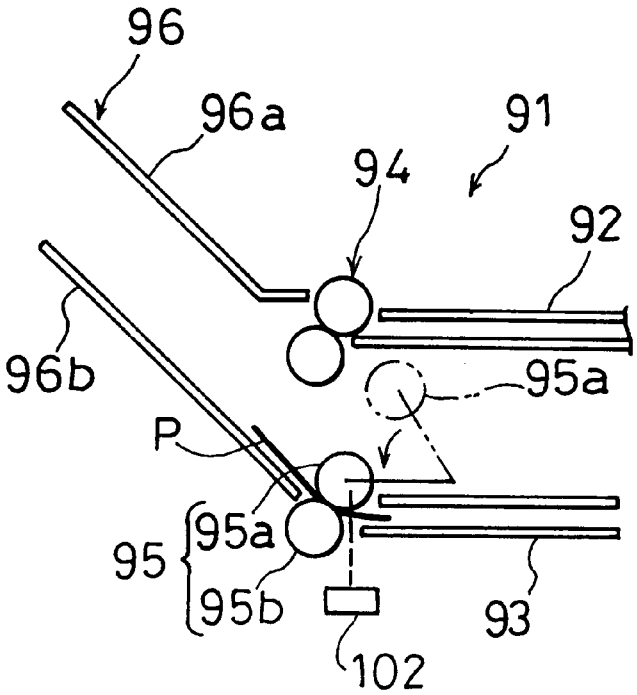
FIG. 29 is a schematic front view showing the second-step operation in the paper-sending operation of the paper-reversing device of FIG. 26.
Figure 33:
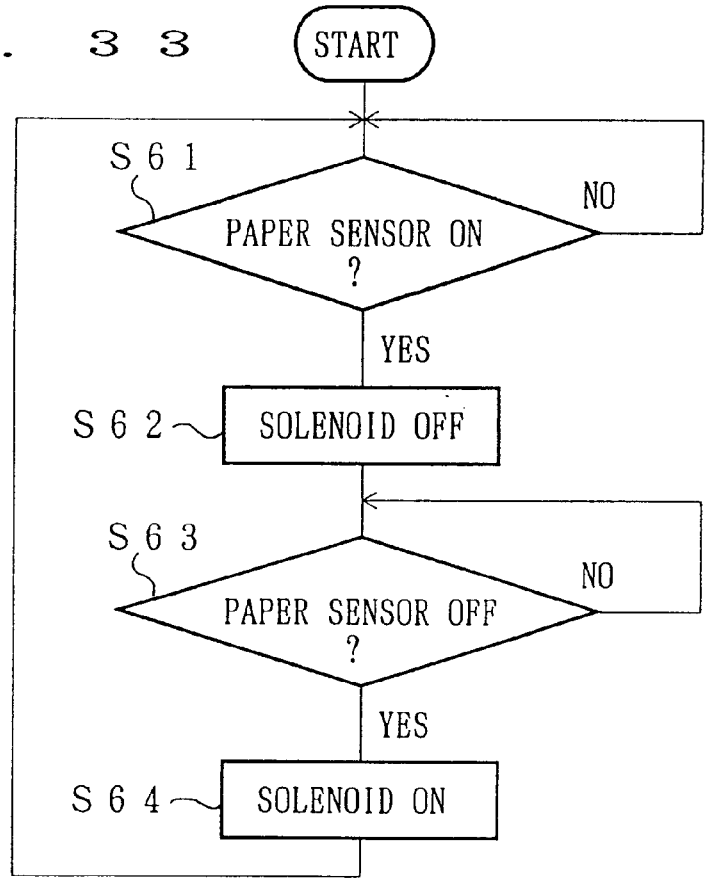
FIG. 33 is a flow chart showing an operation of the paper-reversing device of FIG. 27.

As shown in FIG. 33, when the paper sensor 102 is turned on (S61), the control device 103 turns off the solenoid 100 (S62). Thus, as shown in FIG. 29, the upper paper-feeding roller 95*a* is pressed against the lower paper-sending roller 95*b* with the paper P sandwiched in between. Therefore, the paper P is sent towards the paper-sending guide section 93 from the paper-reversing guide 96 by the upper and lower paper-sending rollers 95*a* and 95*b*, and further sent to the intermediate tray 19 through the paper-sending guide section 93 and the paper-sending guide 18.

Figure 30:
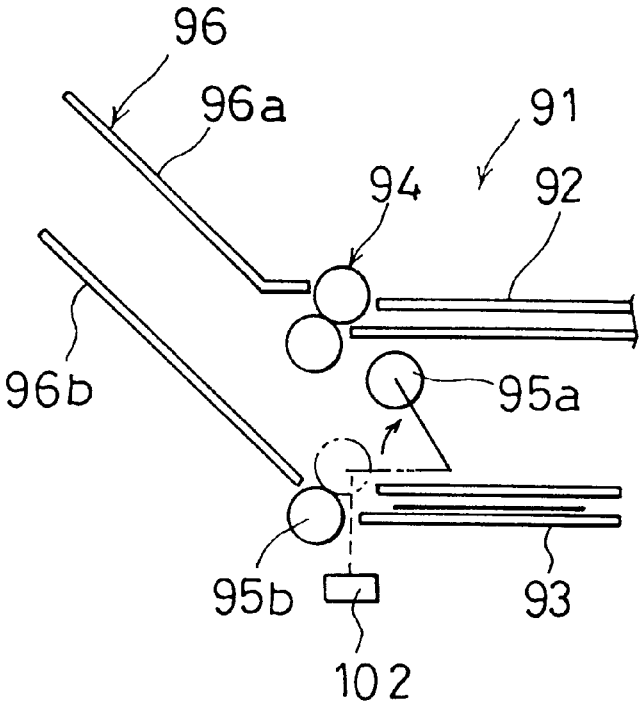
FIG. 30 is a schematic front view showing the third-step operation in the paper-sending operation of the paper-reversing device of FIG. 26.

When the rear end of the paper P has passed over the lower paper-sending roller 95*b* (S63), the control device 103 turns on the solenoid 100 (S64). Thus, as shown in FIG. 30, the upper paper-sending roller 95*a* is separated from the lower paper-sending roller 95*b*, and shifted toward the refuge position located above, thereby getting ready for the next paper.

In the present paper-reversing device 91, the placement of paper onto the lower paper-sending roller 95*b* and the send-out of paper from the paper-reversing device 91 by the use of the upper and lower-paper-sending rollers 95*a* and 95*b* are conducted by the separation of the upper paper-sending roller 95*a* from the lower paper-sending roller 95*b* and the pressing operation of the upper paper-sending roller 95*a* onto the lower paper-sending roller 95*b*. Consequently, it becomes possible to provide a shorter paper interval with respect to the paper-sending operation of paper P.

[Embodiment 7]

Referring to FIGS. 34 through 38, the following description will discuss another embodiment of the present invention. Here, for convenience of explanation, those members that have the same functions and that are described in the aforementioned embodiments are indicated by the same reference numerals and the description thereof is omitted.

Figure 34:
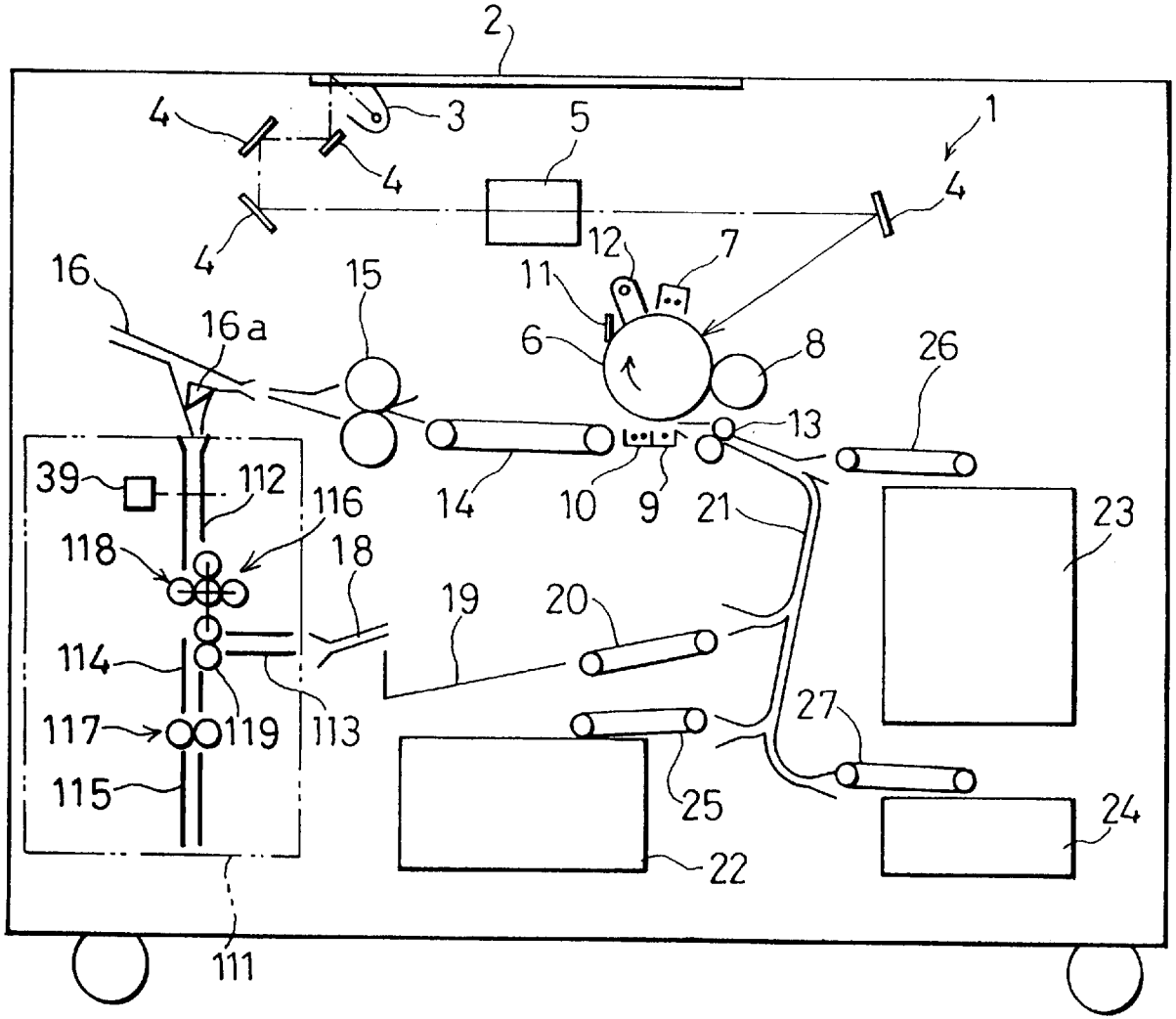
FIG. 34 is a schematic front view which shows an internal structure of a copying machine in which a paper-reversing device of still another embodiment of the present invention is installed.

As illustrated in FIG. 34, the paper-reversing device 111 of the present embodiment is provided with a paper-feeding guide section 112, a paper-reversing guide section 114 and a terminal guide section 115 that are aligned from above to below, and also provided with a paper-sending guide section 113 that is placed in a direction orthogonal to the line of these members. The paper-feeding guide section 112 has its top portion connected to the switching unit 16, and the paper-sending guide section 113 has its one end located on the paper-reversing guide section 114 side, with the other end connected to the paper guide 18. The paper-reversing device 111 has a paper-feeding and sending roller device 116 that functions as a paper-feeding and sending roller means at a joint portion among the paper-feeding guide section 112, the paper-reversing guide section 114 and the paper-feeding guide section 113, and also has a paper-holding roller device 117 that functions as a paper-holding means between the paper-reversing guide section 114 and the terminal guide section 115.

Figure 35:
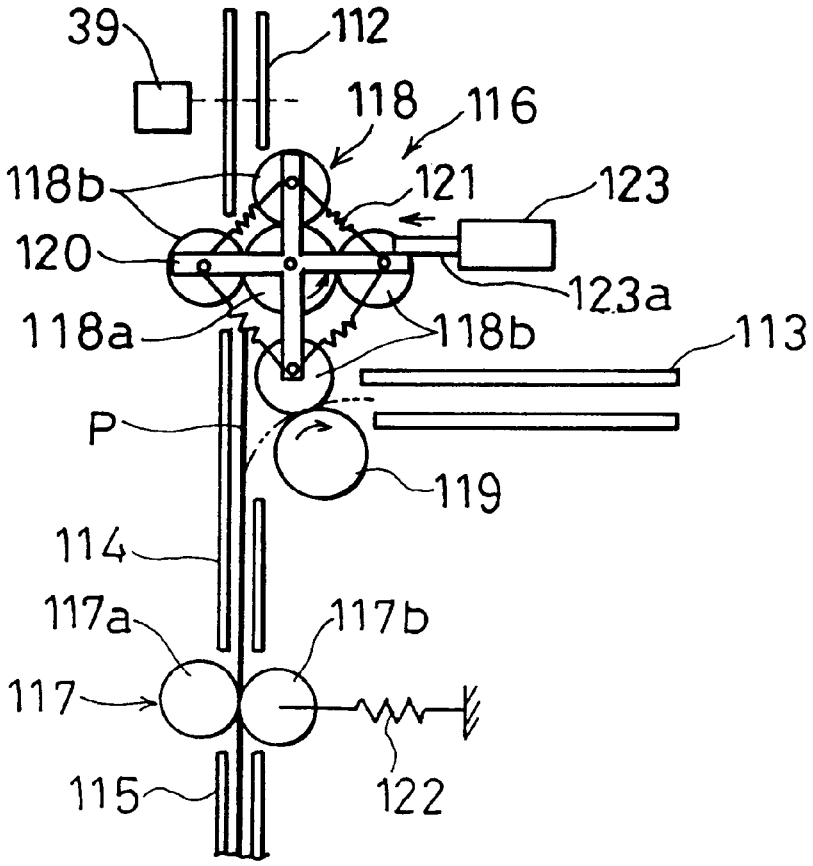
FIG. 35 is a schematic front view which shows a structure of the paper-reversing device of FIG. 34.
Figure 36:
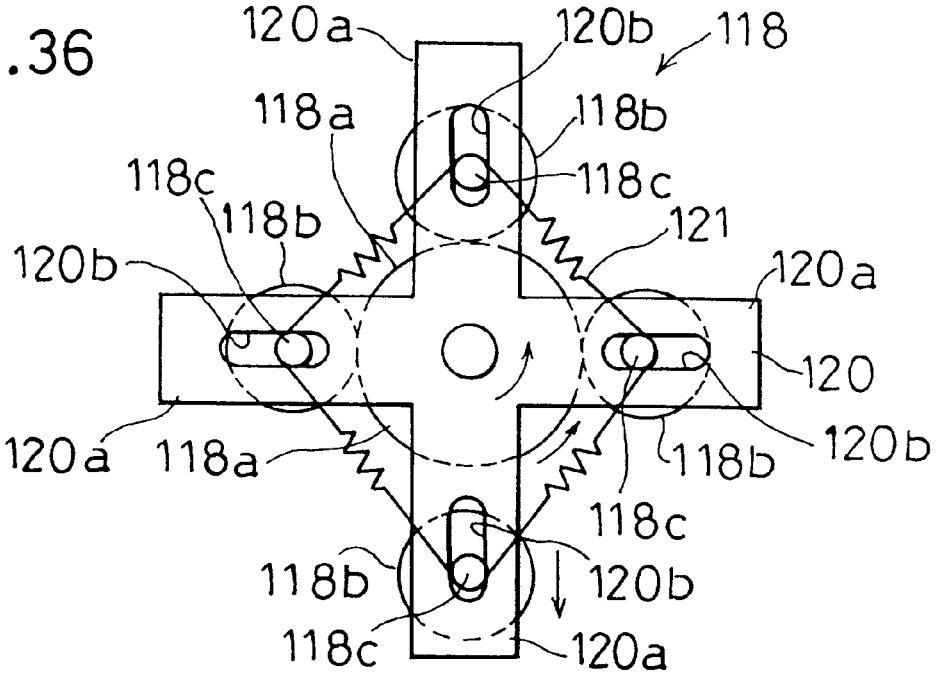
FIG. 36 is a front view which shows a quadruple roller section in an enlarged manner that is shown in FIG. 35.

As illustrated in FIG. 35, the paper-feeding and sending roller device 116 has a quadruple-roller section 118 and a paper-sending roller 119 that is installed below the quadruple-roller section 118. As illustrated in FIG. 36, the quadruple-roller section 118 is constituted of a driving roller 118*a*, placed in the center, and four driven rollers 118*b* that are arranged around it. The driving roller 118*a* is attached to the center of a cross-shaped roller support plate 120 that is a roller support member, so as to freely rotate with respect to the support plate 120. Each driven roller 118*b* has a shaft 118*c* that is attached in a freely rotatable manner to a slotted hole 120*b* that is provided at each of switching sections 120*a* of the roller support plate 120 that are orthogonal to one another. Therefore, each driven roller 118*b* is allowed to shift in directions of the corresponding switching section 120*a*, that is, in a pressing direction toward the driving roller 118*a* and in a separating direction from the driving roller 118*a*.

A ring-shaped spring 121 is passed over the four shafts 118*c* of the driven rollers 118*b* so that the respective driven rollers 118*b* are urged in the pressing directions toward the driving roller 118*a*. The tension of the spring 121 is set to be smaller than the dead weight of the individual driven rollers 118*b*. Therefore, when the driving roller 118*a* rotates, the driven rollers 118*b* revolve around the driving roller 118*a* following the rotation, and one of the driven rollers 118*b*, which has been shifted to a position below the driving roller 118*a*, is separated from the driving roller 118*a*, and allowed to contact the paper-sending roller 119 that is located below, as illustrated in FIG. 35.

As illustrated in FIG. 35, the quadruple-roller section 118 is designed, as its one function, to send a sheet of paper P that has been fed into the paper-feeding guide section 112 to the paper-reversing guide section 114 by using the driving roller 118*a* and the driven rollers 118*b* that are placed between the paper-feeding guide section 112 and the paper-reversing guide section 114. In order to stop the revolution of the driven rollers 118*b*, that is, the rotation of the roller support plate 120, in such an operational state, a solenoid 123, which functions as a paper-feeding and sending state setting means, is provided. The solenoid 123 is designed so that upon the OFF state, a plunger 123*a* advances due to a spring force, not shown, to engage the roller support plate 120 and so that upon the ON state, the plunger 123*a* retracts to release the engagement.

The paper-sending roller 119 is installed between the paper-reversing guide section 114 and the paper-sending guide section 113. One part of the paper-reversing guide section 114, located on the paper-sending roller 119 side, is removed so that the paper P is transported from the paper-reversing guide section 114 to the paper-sending guide section 113 through the paper-sending roller 119.

The paper-holding roller device 117 has the first and second rollers 117*a* and 117*b*, which are paired driven rollers. The second roller 117*b* is pressed against the first roller 117*a* by a spring 122 (a roller-pressing member). The pressing force, exerted by the spring 122, is set to a degree wherein the leading portion of the paper P that has been pushed by the quadruple-roller section 118 and fed into the paper-reversing guide section 114 is allowed to pass between the first and second rollers 117*a* and 117*b*, and wherein the paper P is also held between the first and second rollers 117*a* and 117*b* so as not to drop.

Figure 37:
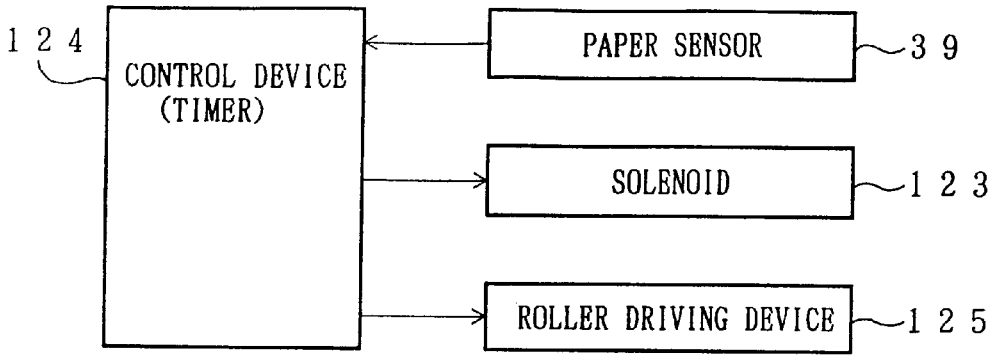
FIG. 37 is a block diagram showing a structure of a control system of the paper-reversing device of FIG. 35.

The solenoid 123 is controlled by a control device 124, shown in FIG. 37, in accordance with the detection made by the paper sensor 39. The control device 124 further controls a roller driving device 125 that rotatably drives the driving roller 118 and the paper-sending roller 119. Further, the control device 124 has a timer that counts predetermined periods of time.

In the above-mentioned arrangement, when a sheet of paper P, which has been subjected to a one-sided copying process, is fed into the paper-feeding guide section 112 of the paper-reversing device 111 through the switching unit 16, the quadruple-roller section 118 of the paper-feeding and sending roller device 116 has its driving roller 118*a* and one of the driven rollers 118*b* located face to face with a lower end of the paper-feeding guide section 112, as shown in FIG. 35. In this case, the solenoid 123 is in the OFF state and the plunger 123*a* has advanced to engage the roller support plate 120. Therefore, the rotation of the roller support plate 120, that is, the revolution of the driven rollers 118*b*, is stopped.

The paper P, which has been fed to the paper-feeding guide section 112, is sent to the paper-reversing guide section 114 by the driving roller 118*a* and one of the driven rollers 118*b*, and its leading portion has passed through the paper-holding roller device 117 to reach the terminal guide section 115. The paper P stops when its rear end has passed between the driving roller 118*a* and the one of the driven rollers 118*b*, since it is no longer subjected to the transporting force. In this state, the paper P is held by the paper-holding roller device 117 so as not to drop.

Figure 38:
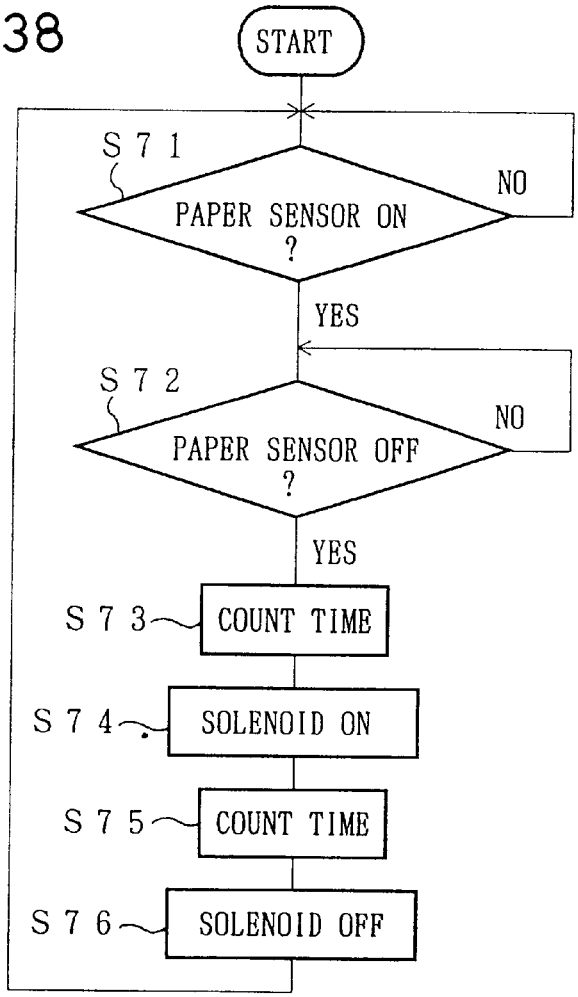
FIG. 38 is a flow chart showing an operation of the paper-reversing device of FIG. 35.

As illustrated in FIG. 38, when the paper P has passed through the paper-feeding guide section 112 as described above, the paper sensor 39 is turned on (S71), and then turned off (S72). In this case, the control device 124 allows the timer to start a predetermined time-counting operation, and upon completion of the time-counting operation (S73), turns on the solenoid 123 (S74). The predetermined time, counted by the timer, corresponds to the time taken from the point when the rear end of the paper P has passed through the paper sensor 39 to the point when it has passed between the driving roller 118*a* and the driven roller 118*b* of the quadruple-roller section 118.

When the solenoid 123 is turned on, the driven rollers 118*b* start revolving. Thus, the one of the driven rollers 118*b*, which has been in contact with the driving roller 118*a*, shifts downward following the rotation, and is pressed against the paper-sending roller 119 by its dead weight. At this time, the rear end of the paper P, which has been located in the vicinity between the driving roller 118*a* and the driven roller 118*b*, is pushed by the driven roller 118*b*, and bent in a sandwiched state between the paper-sending roller 119 and the driven roller 118*b*, as indicated by an alternate long and two short dashes line in FIG. 35.

Here, after having turned on the solenoid 123 at S74, the control device 124 allows the timer to start a predetermined time-counting operation, and upon completion of the time-counting operation (S75), turns off the solenoid 123 (S76). In this case, the predetermined time, counted by the timer, corresponds to the time that is taken for the driven roller 118*b* that has been in contact with the driving roller 118*a* to come into contact with the paper-sending roller 119 by its revolution of 90°. The turning-off of the solenoid 123 allows the plunger 123*a* to engage the roller support plate 120, thereby stopping the revolution of the driven roller 118*b*. This state, shown in FIG. 35, is a stand-by state getting ready for the next paper.

Moreover, the paper P, located between the paper-sending roller 119 and the driven roller 118*b*, is sent from the paper-reversing guide section 114 toward the paper-sending guide section 113 through the above-mentioned processes, and further sent to the intermediate tray 19 through the paper-guide 18.

As described above, the present paper-reversing device 111 makes it possible to simultaneously conduct the paper-sending operation from the paper-reversing guide section 114 by the use of the paper-sending roller 119 and the driven rollers 118*b* and the paper-feeding operation of paper P to the paper-reversing guide section 114 by the use of the driving roller 118*a* and the driven rollers 118*b*. Therefore, it becomes possible to provide a shorter paper interval with respect to the paper-sending operation of paper P.

Furthermore, in the present embodiment, four driven rollers 118*b* are provided, and those driven rollers 118*b* are arranged so that each revolution interval around the driving roller 118*a* is set to 90°. Thus, the driving roller 118 only rotates by 90° from the point when the leading portion of paper has been fed between the driving roller 118*a* and one of the driven roller 118*b* from above to the point when the rear end of paper is started to be sent between the paper-sending roller 119 and the driven roller 118*b* in the horizontal direction. For this reason, it becomes possible to provide by far a shorter paper interval with respect to the paper-sending operation of paper P.

[Embodiment 8]

Figure 39:
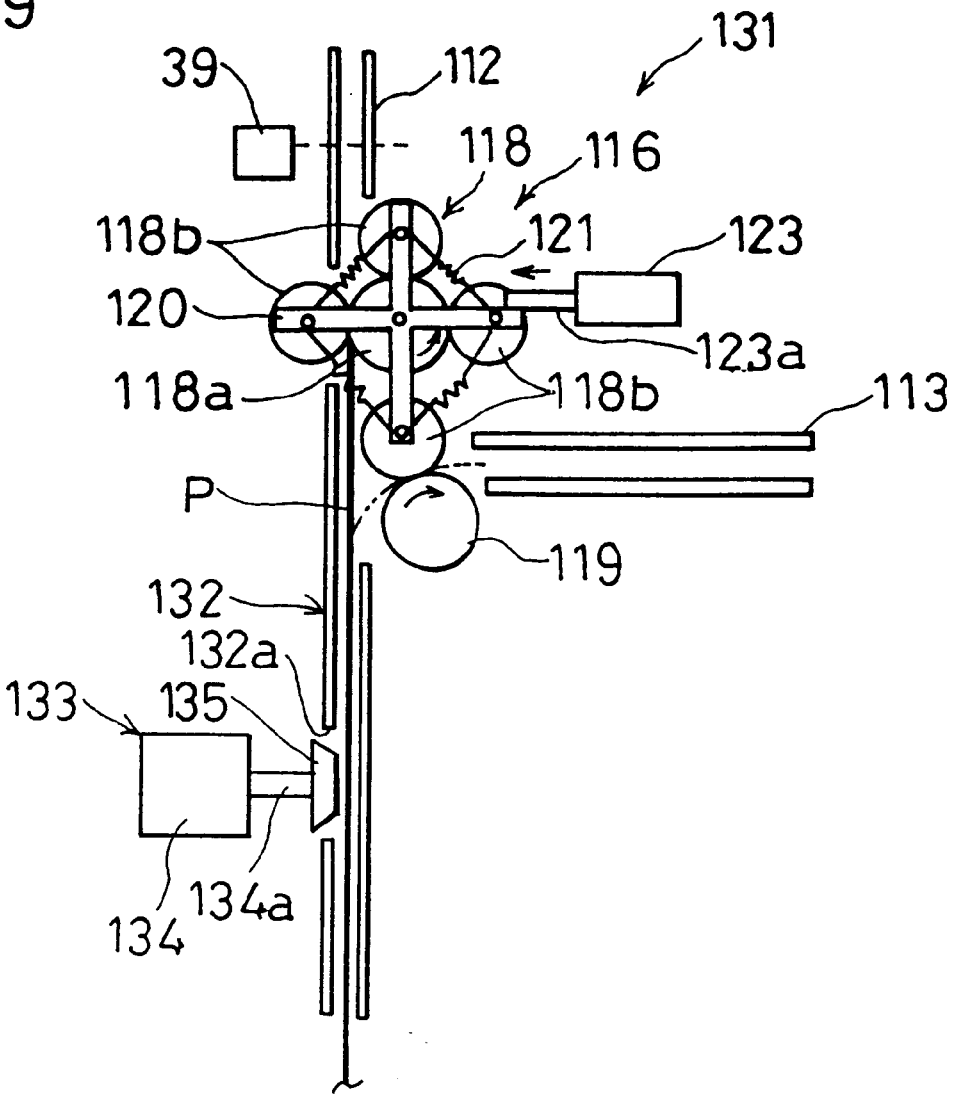
FIG. 39 is a schematic front view showing a paper-reversing device of still another embodiment of the present invention.
Figure 40:
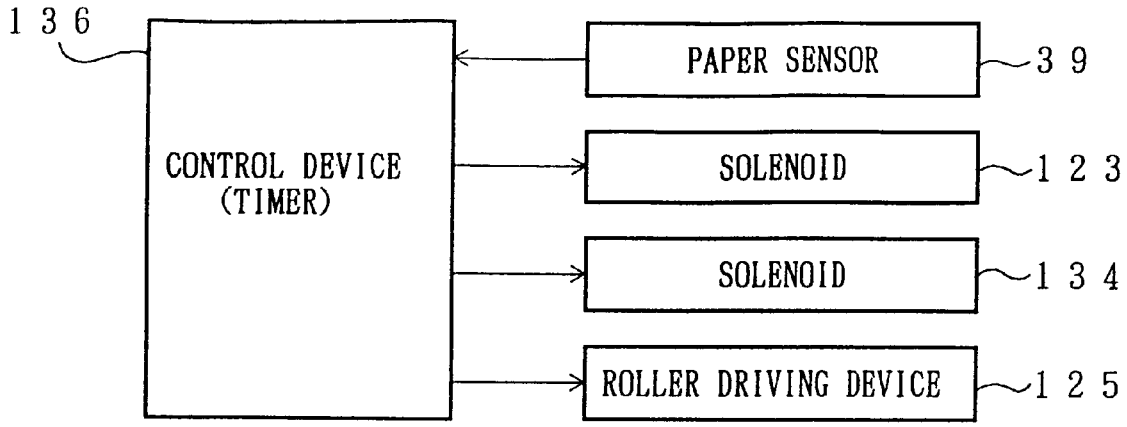
FIG. 40 is a block diagram showing a structure of a control system of the paper-reversing device of FIG. 39.
Figure 41:
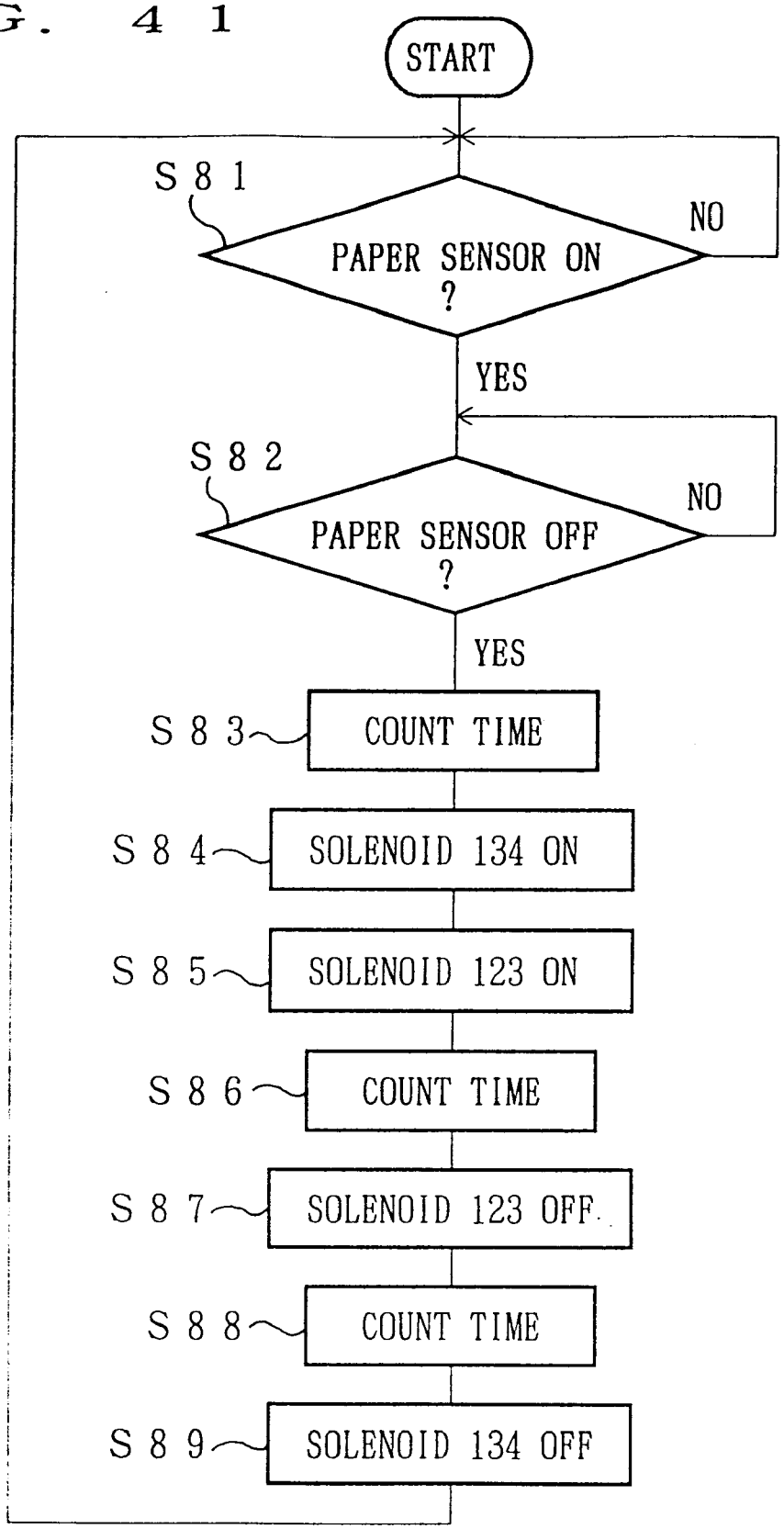
FIG. 41 is a flow chart showing an operation of the paper-reversing device of FIG. 39.

Referring to FIGS. 39 through 41, the following description will discuss another embodiment of the present invention. Here, for convenience of explanation, those members that have the same functions and that are described in the aforementioned embodiments are indicated by the same reference numerals and the description thereof is omitted.

As illustrated in FIG. 39, the paper-reversing device 131 of the present embodiment has the same arrangement as the paper-reversing device 111 shown in FIG. 35 of the above-mentioned Embodiment 7, except that a paper-reversing guide section 132 and a paper-holding device 133 are provided in place of the paper-reversing guide section 114, the terminal guide section 115 and the paper-holding roller device 117.

The paper-holding device 133 is constituted of a solenoid 134 and a paper-pressing member 135, for example, made of sponge, that is attached to the top portion of a plunger 134*a* in the solenoid 134. The plunger 134*a* advances when the solenoid 134 is turned on, and retracts due to the tension of a spring, not shown, when the solenoid 134 is turned off. When the plunger 134*a* advances, the paper-pressing member 135 is inserted into the paper-reversing guide section 132 through its cut-out section 132*a* so that it holds a sheet of paper P in cooperation with the other side wall of the paper-reversing guide section 132.

The solenoid 134 is controlled by a control device 136 shown in FIG. 40. The control device 136 has a timer that counts predetermined periods of time.

In the above-mentioned arrangement, when the paper sensor 39 is turned on (S81) and then turned off (S82) as shown in FIG. 41 with a sheet of paper P having passed through the paper-feeding guide section 112, the control device 136 waits until the rear end of the paper P has passed between the driving roller 118*a* of the quadruple-roller section 118 and one of the driven rollers 118*b* (S83), and turns on the solenoid 134 (S84), as well as turning on the solenoid 123 (S85).

When the solenoid 134 is turned on, the plunger 134*a* advances so that the paper P in the paper-reversing guide section 132 is held at its current position by the paper-pressing member 135. Further, when the solenoid 123 is turned on, one of the driven rollers 118*b*, which has been in contact with the driving roller 118*a*, shifts downward following the revolution, and is pressed against the paper-sending roller 119 by its dead weight, as described earlier. Thus, the rear end of the paper P is brought into a sandwiched state between the paper-sending roller 119 and the driven roller 118*b*.

Here, after having turned on the solenoid 123 at S85, the control device 136 allows the timer to start a predetermined time-counting operation, and upon completion of the time-counting operation (S86), turns off the solenoid 123 (S87). In this case, the predetermined time, counted by the timer, corresponds to the time it takes for the driven roller 118*b* that has been in contact with the driving roller 118*a* to make a revolution of 90° and come into contact with the paper-sending roller 119. The turning-off of the solenoid 123 allows the plunger 123*a* to engage the roller support plate 120, thereby stopping the revolution of the driven roller 118*b*. This state, shown in FIG. 39, is a stand-by state getting ready for the next paper.

Next, after having turned off the solenoid 123 at S87, the control device 136 waits until the plunger 123*a* has engaged the roller support plate 120 (S88), and then turns off the solenoid 134 (S89). Thus, the holding operation of the paper P, made by the paper-pressing member 135, is released, thereby allowing the paper-sending roller 119 and the driven roller 118*b* to send the paper P. Therefore, the paper P is sent out from the paper-reversing guide section 132 to the paper-sending guide section 113 by the two rollers 119 and 118*b*, and further sent to the intermediate tray 19 through the paper guide 18.

In the same manner as the paper-reversing device 111, the present paper-reversing device 131 makes it possible to simultaneously conduct the paper-sending operation from the paper-reversing guide section 132 by the use of the paper-sending roller 119 and the driven rollers 118*b* and the paper-feeding operation of paper P to the paper-reversing guide section 132 by the use of the driving roller 118*a* and the driven rollers 118*b*. Therefore, it becomes possible to provide a shorter paper interval with respect to the paper-sending operation of paper P. Moreover, since the paper-pressing member 135 that is driven by the solenoid 134 is used for holding the paper P in the paper-reversing guide section 132, it becomes possible to ensure a positive holding operation as well as a positive releasing operation from the holding state.

[Embodiment 9]

Referring to FIGS. 42 through 47, the following description will discuss another embodiment of the present invention. Here, for convenience of explanation, those members that have the same functions and that are described in the aforementioned embodiments are indicated by the same reference numerals and the description thereof is omitted.

Figure 42:
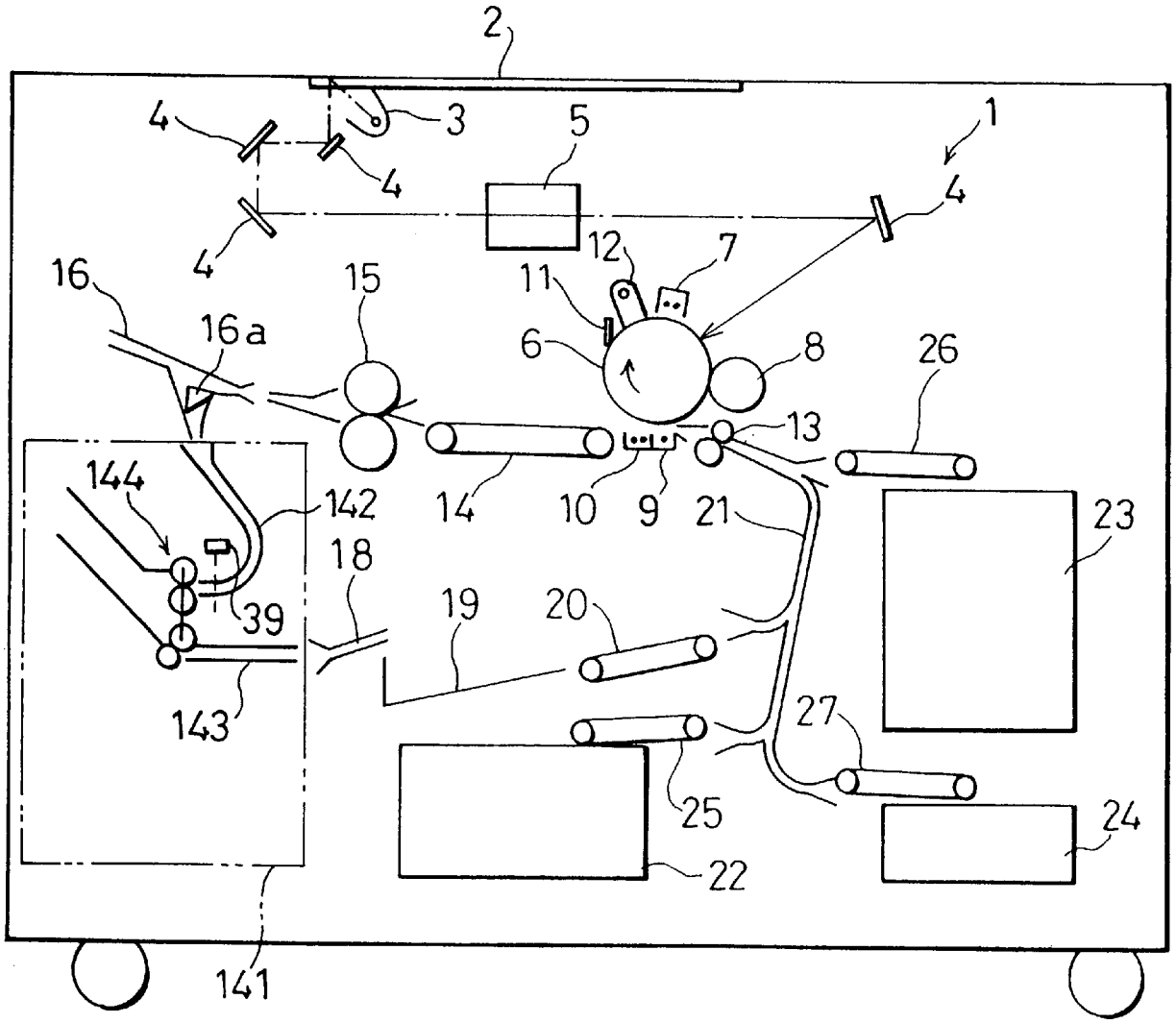
FIG. 42 is a schematic front view which shows an internal structure of a copying machine in which a paper-reversing device of still another embodiment of the present invention is installed.
Figure 43:
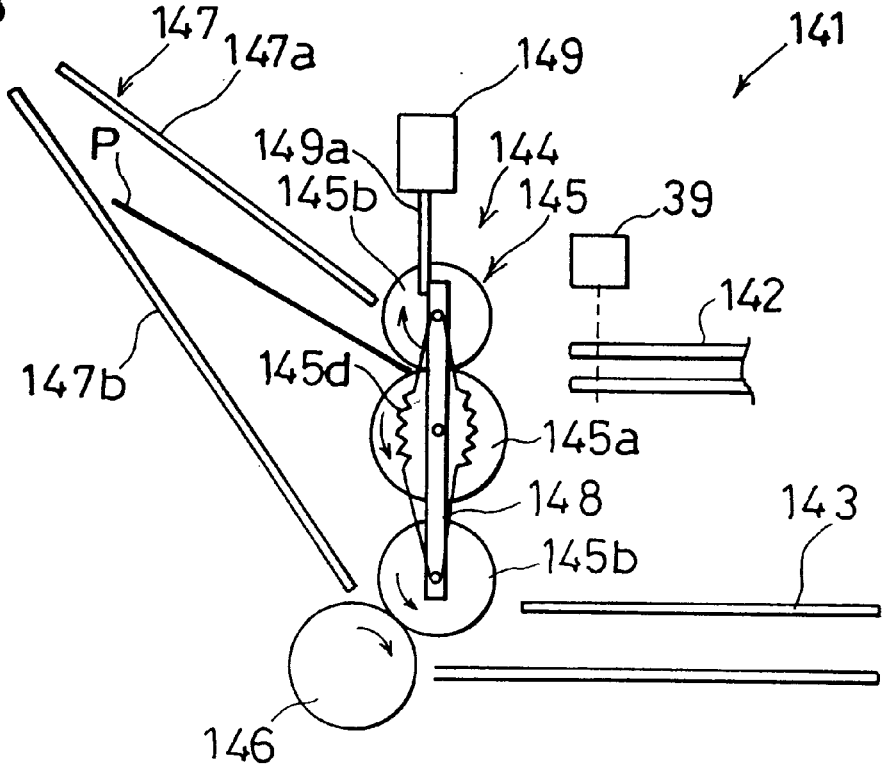
FIG. 43 is a schematic front view which shows a structure of the paper-reversing device of FIG. 42.

As illustrated in FIG. 42, in the paper-reversing device 141 of the present embodiment, a paper-feeding guide section 142 connected to the switching unit 16 and a paper-sending guide section 143 connected to the paper guide 18 are installed in a vertical fashion. As illustrated in FIG. 43, a paper-feeding and sending roller device 144, which functions as a paper-feeding and sending roller means, is attached to a paper-sending position from the paper-feeding guide section 142 and a paper-feeding position to the paper-sending guide section 143 in a bridged manner between the two positions. In the paper-sending roller device 144, a paper-reversing guide 147 is installed on the side opposite to the paper-feeding and paper-sending guide sections 142 and 143.

Figure 44:
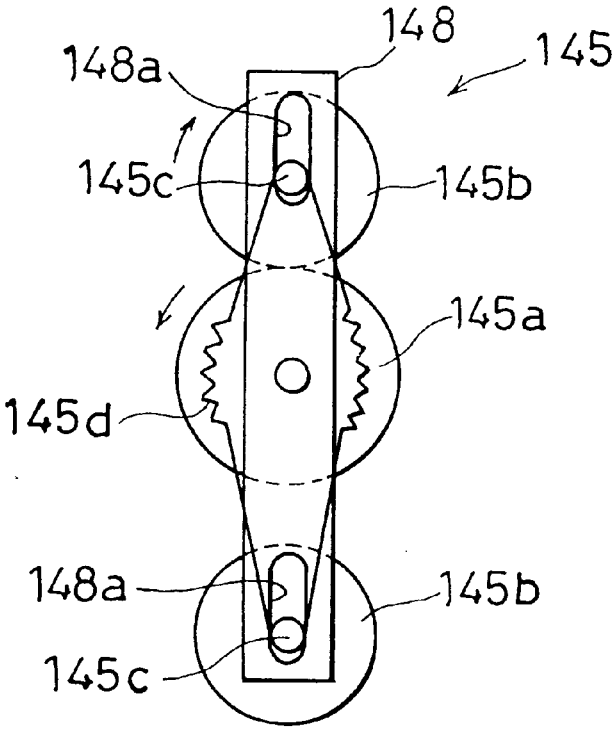
FIG. 44 is a front view which shows a triple roller section in an enlarged manner that is shown in FIG. 43.

The paper-sending roller device 144 has a triple-roller section 145 and a paper-sending roller 146. The paper-sending roller 146 is installed at a paper-feeding position of the paper-sending guide section 143. As illustrated in FIG. 44, the triple-roller section 145 is constituted of a driving roller 145*a*, placed in the center, and two driven rollers 145*b* that are located around it. The driving roller 145*a* is attached to the center of a straight roller support plate 148 that is a roller support member so as to freely rotate on the roller support plate 148, and placed at the paper-sending position of the paper-feeding guide section 142. Each driven roller 145*b* has its shaft 145*c* attached to a slotted hole 148*a* that is formed in the roller support plate 148 in the lengthwise direction so that it freely rotates thereon. Therefore, the respective driven rollers 145*b* are allowed to shift in a pressing direction to the driving roller 145*a* as well as in a separating direction from the driving roller 145*a*.

A ring-shaped spring 145*d* (a roller-pressing member) is passed over the two shafts 145*c* of the driven rollers 145*b* so that the respective driven rollers 145*b* are urged in the pressing directions toward the driven roller 145*a*. The tension of the spring 145*d* is set to be smaller than the dead weight of the individual driven rollers 145*b*. One of the driven rollers 145*b*, located on the driving roller 145*a*, is pressed against the driving roller 145*a* by its dead weight. When the driving roller 145*a* rotates, the driven rollers 145*b* revolve around the driving roller 145*a* following the rotation, and one of the driven rollers 145*b*, which has been shifted to a position below the driving roller 145*a*, is separated from the driving roller 145*a*, and allowed to contact the paper-sending roller 146 that is located below, as illustrated in FIG. 43.

As illustrated in FIG. 43, the triple-roller section 145 is designed, as its one function, to send a sheet of paper P that has been fed into the paper-feeding guide section 142 to the paper-reversing guide section 147 by using the driving roller 145*a* that is placed at the paper-sending position of the paper-feeding guide section 142 and the driven roller 145*b* that is located thereon. In order to stop the revolution of the driven rollers 145*b*, that is, the rotation of the roller support plate 148, in such an operational state, a solenoid 149, which functions as a paper-feeding and sending state setting means, is provided. In the stopped state of the roller support plate 148 made by the solenoid 149, the driven roller 145*b* is pressed against the paper-sending roller 146 by its dead weight. The solenoid 149 is designed so that upon the OFF state, a plunger 149*a* advances due to a spring force, not shown, to engage the roller support plate 148 and so that upon the ON state, the plunger 149*a* retracts to release the engagement.

The paper-reversing guide 147 is constituted of an upper guide section 147*a* and a lower guide section 147*b*, and the upper guide section 147*a* is located at a paper-sending position formed by the driving roller 145*a* of the triple-roller section 145 and the driven roller 145*b* that is placed thereon.

The lower guide section 147*b* is located at a paper-feeding position formed by the paper-sending roller 146 and the driven roller 145*b* that is placed thereon. The lower guide section 147*b* is inclined in such a manner that its end on the paper-sending roller 146 side forms a lower end.

Figure 46:
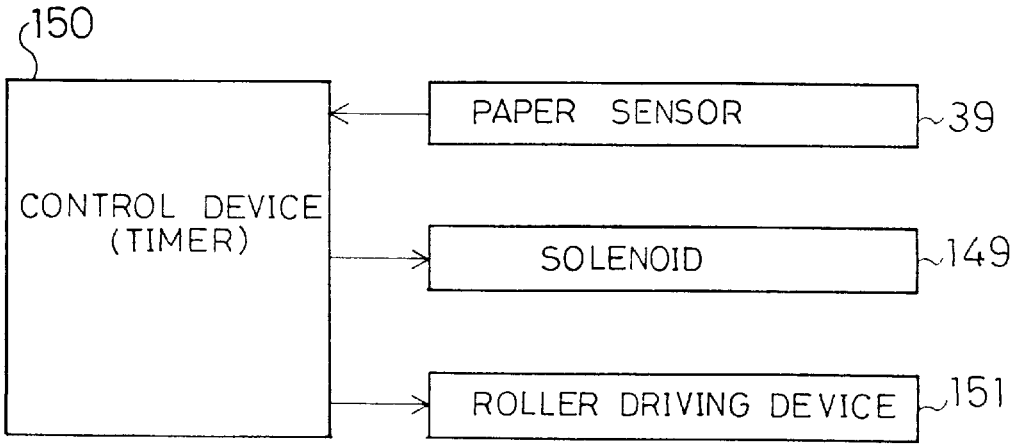
FIG. 46 is a block diagram showing a structure of a control system of the paper-reversing device of FIG. 43.

The solenoid 149 is controlled by a control device 150, shown in FIG. 46, in accordance with the detection made by the paper sensor 39. The control device 150 further controls a roller driving device 151 that rotatably drives the driving roller 145*a* and the paper-sending roller 146. Further, the control device 150 has a timer that counts predetermined periods of time.

In the above-mentioned arrangement, when a sheet of paper P, which has been subjected to a one-sided copying process, is fed into the paper-feeding guide section 142 of the paper-reversing device 141 through the switching unit 16, the triple-roller section 145 of the paper-feeding and sending roller device 144 has its driving roller 145*a* and one of the driven rollers 145*b* located face to face with a terminal portion of the paper-feeding guide section 142, as shown in FIG. 43. In this case, the solenoid 149 is in the OFF state and the plunger 149*a* has advanced to engage the roller support plate 148. Therefore, the rotation of the roller support plate 148, that is, the revolution of the driven rollers 145*b*, is stopped.

Figure 47:
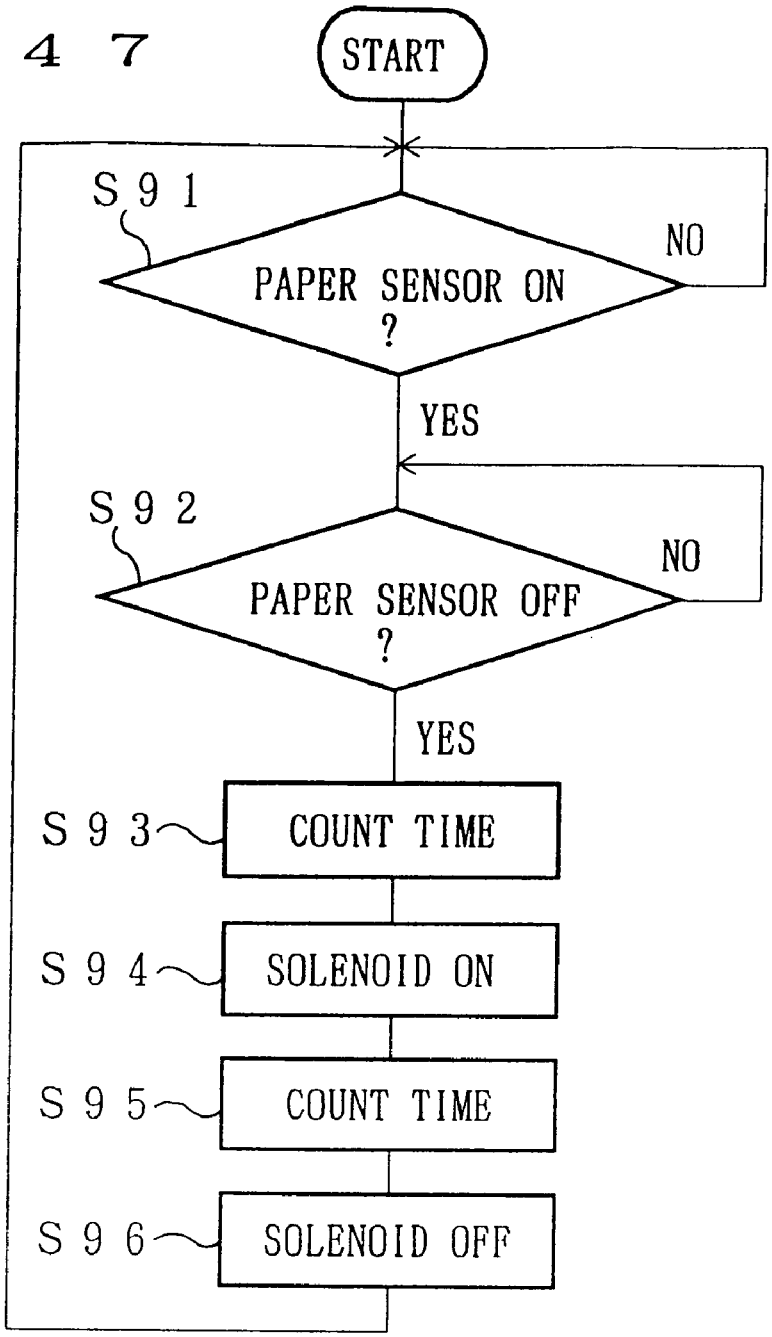
FIG. 47 is a flow chart showing an operation of the paper-reversing device of FIG. 43.
Figure 48:
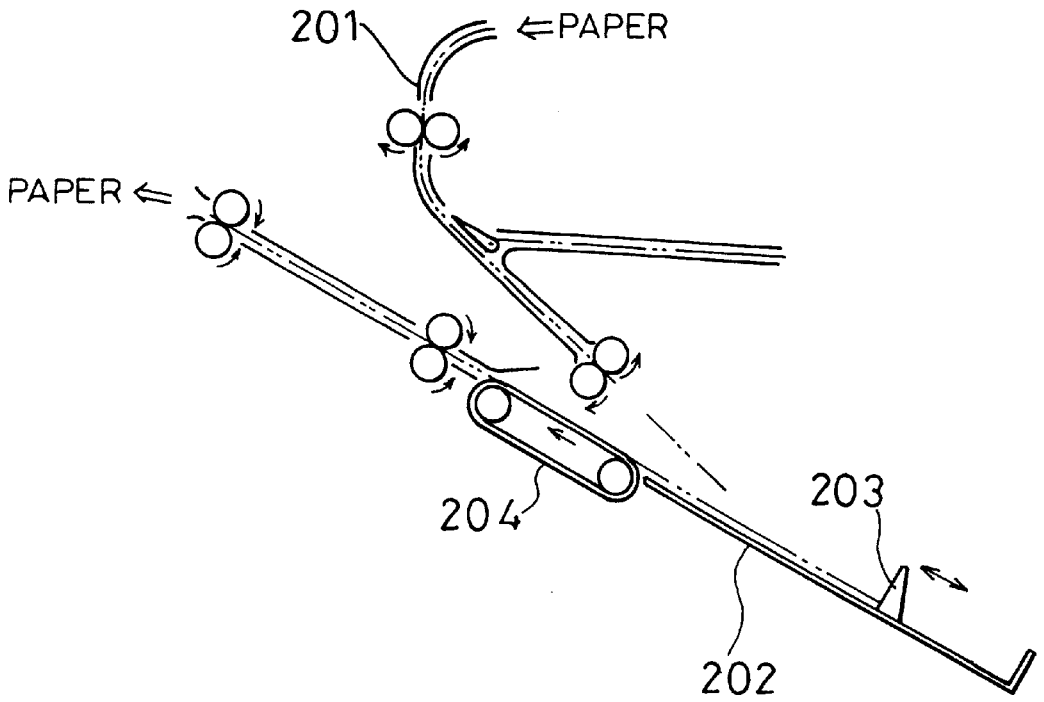
FIG. 48 PRIOR ART
FIG. 48 is a schematic front view showing a conventional paper-reversing device.

The paper P, which has been fed to the paper-feeding guide section 142, is sent to the paper-reversing guide section 147 by the driving roller 145*a* and one of the driven rollers 145*b*. When the paper P passes through the paper sensor 39, the paper sensor 39 is turned on (S91), and then turned off (S92), as shown in FIG. 47. At this time, the control device 150 allows the timer to start a predetermined time-counting operation, and upon completion of the time-counting operation (S93), turns on the solenoid 149 (S94). The predetermined time, counted by the timer, corresponds to the time taken from the point when the rear end of the paper P has passed through the paper sensor 39 to the point when it has passed between the driving roller 145*a* and the driven roller 145*b* of the triple-roller section 145.

Figure 45:
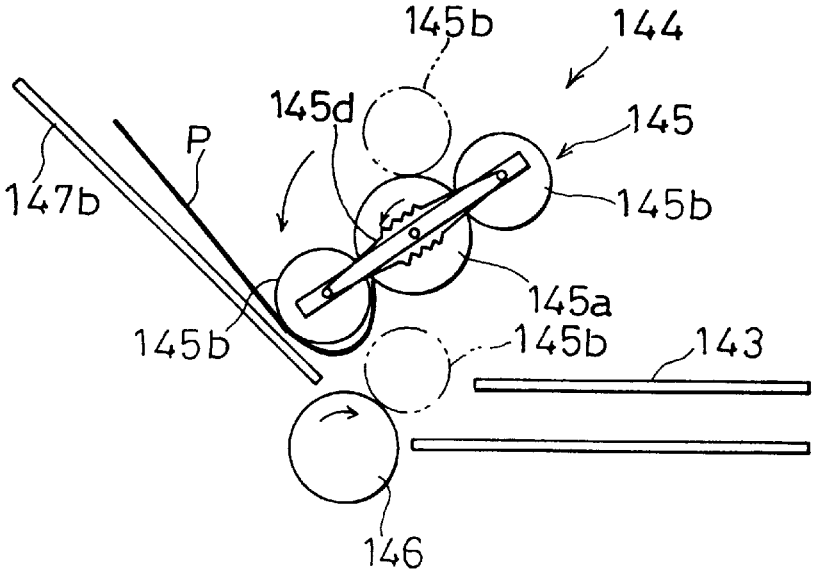
FIG. 45 is a schematic front view showing the paper-sending operation of the paper-reversing device of FIG. 43.

When the solenoid 149 is turned on, the driven rollers 145*b* start revolving. Thus, the one of the driven rollers 145*b*, which has been in contact with the driving roller 145*a*, shifts downward following the revolution, and is pressed against the paper-sending roller 146 by its dead weight. At this time, the rear end of the paper P, which has been located in the vicinity between the driving roller 145*a* and the driven roller 145*b*, is pushed down by the driven roller 145*b*, and brought into a sandwiched state between the paper-sending roller 146 and the driven roller 145*b*, as shown in FIG. 45.

Here, after having turned on the solenoid 149 at S94, the control device 150 allows the timer to start a predetermined time-counting operation, and upon completion of the time-counting operation (S95), turns off the solenoid 149 (S96). In this case, the predetermined time, counted by the timer, corresponds to the time that is taken for the driven roller 145*b* that has been in contact with the driving roller 145*a* to come into contact with the paper-sending roller 146 by its revolution of 180°. The turning-off of the solenoid 149 allows the plunger 149*a* to engage the roller support plate 148, thereby stopping the revolution of the driven roller 145*b*. This state, shown in FIG. 43, is a stand-by state getting ready for the next paper. Therefore, the paper P is sent from the paper-reversing guide 147 to the paper-sending guide section 143 by the two rollers 146 and 145*b*, and further sent to the intermediate tray 19 through the paper guide 18.

As described above, the present paper-reversing device 141 makes it possible to simultaneously conduct the paper-sending operation from the paper-reversing guide section 147 by the use of the paper-sending roller 146 and the driven rollers 145*b* and the paper-feeding operation of paper P to the paper-reversing guide section 147 by the use of the driving roller 145*a* and the driven rollers 145*b*. Therefore, it becomes possible to provide a shorter paper interval with respect to the paper-sending operation of paper P.

Furthermore, in the present embodiment, two driven rollers 145*b* are provided, and these driven rollers 145*b* are arranged so that each revolution interval around the driving roller 145*a* is set to 180°. Further, sheets of paper are directed to the paper-reversing guide 147 in the horizontal direction. Consequently, the paper-reversing guide 147 only needs to provide a space for housing paper, and eliminates the need for a mechanism for preventing the paper from moving in directions other than the direction of the paper-feeding roller 146. This makes it possible to simplify the device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper-reversing device comprising:

paper-feeding and sending roller device including:

a driving roller that rotates in one direction, a plurality of driven rollers that are installed around the driving roller and come in contact with the driving roller, and that revolve around the driving roller while rotating on their respective axes following the rotation of the driving roller, a paper-sending roller that rotates without contacting the driving roller, and a roller supporting member that supports the axes of the driven rollers so as to allow them to rotate freely, and that provides a paper-feeding and sending state, wherein a predetermined one of said driven rollers is kept in contact with the paper-sending roller while another one of the driven rollers located behind the predetermined driven roller, is kept in contact with the driving roller, by making the predetermined driven roller separate from the driving roller and contact the paper-sending roller at a predetermined time during the revolution of the driven rollers around the driving roller;

a paper-feeding guide section for guiding a sheet of paper between the driving roller and the driven roller that has been kept in contact with the driving roller during the paper-feeding and sending state;

a paper-reversing guide section to which the sheet of paper that has passed between said another driven roller and the driving roller while being guided by the paper-feeding guide section is fed in the paper-feeding and sending state, and which is designed so that the rear end of the sheet of paper is allowed to move onto the paper-sending roller; and a paper-feeding and sending state setting means which sets the paper-feeding and sending roller device to the paper-feeding and sending state by blocking the revolution of the driven rollers, and releases the paper-feeding and sending roller device from the state.

2. The paper-reversing device as defined in claim 1, wherein the paper-reversing guide section is designed to have a space through which the rear end of the paper is allowed to shift onto the paper-sending roller.

3. The paper-reversing device as defined in claim 1, wherein the driven roller, which has been kept in contact with the driving roller during the paper-feeding and sending state, pushes the rear end of the paper toward the paper-sending roller when while separating from the driving roller when revolving around the driving roller and comes into contact with the paper-sending roller so that the rear end of the paper is shifted onto the surface of the paper-sending roller.

4. The paper-reversing device as defined in claim 1, wherein:

the paper-sending roller is installed below the driving roller;

the driven rollers pass below the driving roller in the revolution; and when the predetermined driven roller that separates from the driving roller and is pressed against the paper-sending roller reaches a position below the driving roller, the roller supporting member allows the predetermined driven roller to separate from the driving roller due to dead weight of the predetermined driven roller and come into press-contact with the paper-sending roller.

5. The paper-reversing device as defined in claim 4, wherein the roller supporting member includes a roller-pressing member for making the driven rollers into press-contact with the driving roller when the driven rollers are not located below the driving roller.

6. The paper-reversing device as defined in claim 5, wherein the roller-pressing member is a spring whose respective ends are fixed to shafts of the adjacent driven rollers.

7. The paper-reversing device as defined in claim 1, wherein the paper-feeding and sending state setting means includes a plunger that is urged by a solenoid and a spring in corresponding opposite directions and the plunger blocks the revolution of the driven rollers by engaging the roller supporting member.

8. The paper-reversing device as defined in claim 1, further comprising:

a paper sensor for detecting whether or not the paper has passed through a predetermined position on the paper-feeding guide section.

9. The paper-reversing device as defined in claim 1 further comprising:

paper-holding means for holding the paper that has been fed into the paper-reversing guide section.

10. The paper-reversing device as defined in claim 9, wherein the paper-holding means includes two rollers that are kept in contact with each other so as to rotate in reverse directions and a spring that brings at least one of the rollers into press-contact with the other roller.

11. The paper-reversing device as defined in claim 9, the paper-holding means includes a plunger that is urged by a solenoid and a spring in corresponding opposite directions.

12. The paper-reversing device as defined in claim 9, wherein:

the driven rollers are four rollers that are arranged around the driving roller at 90-degree angles from each other; and the paper is guided from the paper-feeding guide section downward, and fed by the paper-reversing guide section in a downward direction.

13. The paper-reversing device as defined in claim 1, wherein:

the driven rollers are two rollers that are arranged around the driving roller with an angle of 180° respectively; and the paper is guided from the paper-feeding guide section to the paper-reversing guide section in a horizontal direction and the paper-reversing guide section allows the rear end of the paper to drop.

* * * * *